US009625179B1

(12) United States Patent
Margolin

(10) Patent No.: US 9,625,179 B1
(45) Date of Patent: Apr. 18, 2017

(54) SYSTEM TO PROVIDE A BACKCHANNEL TO AN HVAC THERMOSTAT

(71) Applicant: Jed Margolin, VC Highlands, NV (US)

(72) Inventor: Jed Margolin, VC Highlands, NV (US)

( * ) Notice: Subject to any disclaimer, the term of this patent is extended or adjusted under 35 U.S.C. 154(b) by 0 days.

(21) Appl. No.: 15/137,038

(22) Filed: Apr. 25, 2016

Related U.S. Application Data

(60) Provisional application No. 62/310,817, filed on Mar. 21, 2016.

(51) Int. Cl.
*F24F 11/053* (2006.01)
*G05D 23/00* (2006.01)
*F24H 9/20* (2006.01)

(52) U.S. Cl.
CPC ..... *F24H 9/2064* (2013.01)

(58) Field of Classification Search
CPC ... F24D 19/1084; F24F 11/0009; G05D 23/20
USPC ..... 236/1 C, 51; 700/276, 278
See application file for complete search history.

(56) References Cited

U.S. PATENT DOCUMENTS 281,884 A 7/1883 Johnson
1,822,605 A 9/1931 Teeple
2,129,477 A 9/1938 Parks
3,815,668 A 6/1974 Carlson
3,942,718 A 3/1976 Palmieri
4,083,397 A * 4/1978 Kimpel ..... F24F 11/0009 165/265
4,211,362 A 7/1980 Johnson
4,442,972 A 4/1984 Sahay et al.
4,776,514 A * 10/1988 Johnstone ..... G05D 23/24 165/253
5,272,427 A * 12/1993 Nold ..... F23N 5/203 318/102
5,452,762 A 9/1995 Zillner
6,535,838 B2 3/2003 Abraham et al.
2012/0130547 A1* 5/2012 Fadell ..... F24F 11/0009 700/276
2013/0173064 A1* 7/2013 Fadell ..... G05D 23/1902 700/276
2014/0312694 A1* 10/2014 Tu ..... F24F 11/006 307/39
2014/0316581 A1* 10/2014 Fadell ..... F24F 11/0009 700/276

OTHER PUBLICATIONS

Manual for Honeywell RTH6500WF Wi-Fi Thermostat.

(Continued)

*Primary Examiner* — Henry Crenshaw

(57) ABSTRACT

In an HVAC system Polarity Splitting is used to provide for one or more backchannels from the furnace to the thermostat. Polarity Splitting is also used to allow a four-wire house cable to provide for three thermostat functions as well as furnace power to the thermostat while also providing for one or more backchannels. A serial datalink can be used to provide for a number of thermostat functions and a number of backchannels as well as to provide furnace power to the thermostat while using only three wires between the furnace and the thermostat. A Wi-Fi enabled furnace adapter can allow the use of a Wi-Fi thermostat while supplying only furnace power (two wires) to the thermostat. A Wi-Fi enabled furnace can use only a remote temperature sensor instead of a remote thermostat.

9 Claims, 15 Drawing Sheets

(56) References Cited

OTHER PUBLICATIONS

Rheem/Ruud Technical Service Bulletin 1610.
Rheem Dealer Installation and Startup Instructions for 500 Series Thermostat; Amazon price for Rheem 500-Series Touchscreen Communicating Programmable Thermostat (Mar. 9, 2016).
Instruction Manual for White Rodgers P200 thermostat.
Wi-Fi Direct https://en.wikipedia.org/wiki/Wi-Fi_Direct Downloaded Dec. 27, 2015.
Texas Instruments MSP430 G2 Launchpad. http://www.ti.com/tool/msp-exp430g2.
Raspberry Pi Computer. https://en.wikipedia.org/wiki/Raspberry_Pi Downloaded Mar. 19, 2016.

* cited by examiner

304

305

Adapter 3 - Thermostat Adapter Part 1
MSP430G2211
802
801
Line Sensor
VCC
Xin
Xout
TEST
RST
VSS
P1.0
P1.1
P1.2
P1.3
P1.4
P1.5
P1.6
P1.7
3.3VDC
C9 0.1
C10 12pF
X1 32.768 KHz
C11 12pF
3.3V
R4 10K
C12 1000pF
PB1 Reset
ACLK
SMCLK
nc
24VDC
C4 10uF 35V
C3 0.1
VR1 LM7824
C2 0.1
36VDC
C1 100uF 50V
D1
24VAC
R
24VAC_C
VR2 LM7812 12V
C5 0.1
VR3 LM1117T 3.3V
C6 0.1
C7 10uF 35V
Neg
Pos
60Hz
3.3V
0V
R1 10K
Z1 3.3V
R2 100K
C8 470pF
R3 10K
Q1 2N3904

SYSTEM TO PROVIDE A BACKCHANNEL TO AN HVAC THERMOSTAT

CROSS REFERENCES TO RELATED APPLICATIONS

This application claims the benefit of U.S. Provisional Application No. 62/310,817 filed on Mar. 21, 2016, which is hereby incorporated by reference herein.

BACKGROUND OF THE INVENTION

Field of Invention

This invention relates to the field of Heating, Ventilation, and Air Conditioning (HVAC) and, in particular, to connecting a thermostat to an HVAC unit.

A Furnace Control Board is the control board that operates the furnace by controlling the furnace parts (such as the inducer motor, flame igniter, gas valve, blower, heating element), generally comes with the furnace, and is responsive to an external control such as a thermostat.

A Backchannel is a channel of communications that goes from the furnace control board or furnace control board adapter to the thermostat or thermostat adapter. This direction is opposite to the normal direction of signals which is from the thermostat to the furnace control board.

Polarity Splitting means that the positive and negative half-cycles of an AC signal may be used for different functions. Polarity Splitting will mean the same as Polarity Separation.

A Wireless Access Point (WAP) is a networking hardware device that allows wireless devices to connect to a wired network using Wi-Fi or related standards. The Wireless Access Point may connect to a router (via a wired network) as a standalone device, but it can also be an integral component of the router itself. The term Wireless Access Point will mean the same thing as Wireless Router.

The term UART means a Universal Asynchronous Receiver/Transmitter.

The terms House Wiring and House Cable mean the wires installed between the furnace and the thermostat regardless of the type of structure it is installed in. A House Wire is a wire in a House Cable.

The term Furnace Power means the low voltage used to operate the furnace control board. Furnace Power is typically 24 VAC.

The term "Line Sensor" means the same as "AC power phase detector."

The term Relay means an electromechanical relay as well as a solid state relay.

Prior Art

There are several different type of furnaces and several different methods used to control them.

Some furnaces, especially electric heaters, require that the thermostat control a circuit operating at Mains power, typically 120 VAC.

There are Millivolt control systems where the furnace uses a thermopile in a pilot flame to produce power for the furnace to open the gas valve. This was one of the first control systems for gas heating appliances and they were installed on gravity type furnaces since the power from the thermopile was insufficient to run a blower in a forced air system. This method is still commonly used in gas hot water heaters because the heat from the pilot is not wasted. It simply adds to the heat for keeping the water hot. Also, a conventional water heater does not have a blower.

More commonly, thermostats control the furnace by closing a low-voltage two-wire circuit operating at the defacto standard of 24 VAC.

Before there were electronic thermostats the thermostats were mechanical devices that used a bimetallic strip made of two dissimilar metals that expand and contract at different rates as the temperature changes. An early patent that teaches the use of a bimetallic strip is U.S. Pat. No. 281,884 Electric Tele-Thermoscope issued Jul. 24, 1883 to Warren S. Johnson. (IDS Cite 1 Column 1, lines 16-34 and Column 2 lines 87-95) The two dissimilar metal strips are wound together in a spiral with the inside end fixed and the outside end controlling a beam lever. Under each contact point of the beam lever is a small cup of mercury. When the temperature is below the set point one end of the beam contacts its pool of mercury and the contact on the other end of the beam is lifted out of its mercury pool. When the temperature is above the set point the beam lever pivot reverses which pool of mercury is in contact with its respective beam lever contact.

This evolved so that instead of two open cups of mercury the mercury was in a sealed capsule with two electrodes. As before, the bimetallic strip is wound in a spiral with the inside fixed. However, instead of the open cups of mercury the mercury capsule is mounted at the free end of the spiral. The expansion and contraction of the bimetallic strip around the set point causes the mercury capsule to tilt one way or the other. One way causes the mercury to wet the electrodes and complete the circuit. The other way draws the mercury away from the electrodes opening the circuit. The mercury capsule is elongated to produce hysteresis. An example of a mercury switch thermostat is U.S. Pat. No. 1,822,605 Mercury switch thermostat issued Sep. 8, 1931 to Teeple. (IDS Cite 2) It should be appreciated that thermostats with mercury must be installed perfectly level or the set point will be wrong.

In other mechanical bimetallic strip thermostats the bimetallic strips directly make (or do not make) electrical contact with each other. Hysteresis is provided by a magnet. An example is U.S. Pat. No. 2,129,477 Adjustable metallic thermostat issued Sep. 6, 1938 to Parks. (IDS Cite 3)

These mechanical thermostats require only two wires to turn the furnace on.

Nowadays, although there are still mechanical thermostats most thermostats are electronic and need power to operate. An example of an early patent for an electronic thermostat is U.S. Pat. No. 3,942,718 Electronic thermostat issued Mar. 9, 1976 to Palmieri. {IDS Cite 4} This patent does not show where it gets its power from but since it uses discrete logic it is unlikely that the power came from batteries. When the patent application was filed in 1973 there were no microcontrollers, and microprocessors required considerable support circuitry, all of which required more power than was practical to get from batteries for long term use. Therefore, this thermostat would have required external power.

An example of an early patent for a User programmable thermostat is U.S. Pat. No. 4,442,972 Electrically controlled programmable digital thermostat and method for regulating the operation of multistage heating and cooling systems issued Apr. 17, 1984 Sahay, et al. {IDS Cite 5} This patent also required external power. See FIG. 5 element 35. It is the furnace transformer.

Since thermostats using the technology taught by both '718 and '972 would have required external power (such as furnace power) the sales of these thermostats would have generally been limited to new construction and to homeowners willing to install (or have installed) a new cable from the furnace to the thermostat.

Nowadays with the availability of very low power microcontrollers a thermostat may operate solely from its batteries. Some thermostats are designed so that the batteries may last for several years before they need to be replaced. Some thermostats may need its batteries replaced in as little as a year. If the batteries die the furnace will not work and the home's residents may wake up in the morning to a very cold house. If the residents are away at the time the failure of the furnace to operate may result in frozen and burst water pipes.

Some thermostats augment battery power by the process known as Power Stealing. In Power Stealing the thermostat operates on a small leakage current through the furnace controller input. This leakage current must be small enough so the furnace controller does not recognize it as a valid control input such as Call for Heat, Call for Cooling, or a manual fan control (Auto/Fan). An early patent that teaches Power Stealing is U.S. Pat. No. 4,211,362 Smoke detecting timer controlled thermostat issued Jul. 8, 1980 to Johnson. {IDS Cite 6}

Power Stealing generally uses only one furnace control input, such as Call for Heat. As a result, during a Call for Heat (which turns the furnace on) the thermostat contacts are closed and there is no power available to steal. There do not appear to be thermostats that steal power from more than one circuit. For example, in a system with both a furnace and an air conditioner they will not both be on at the same time. The reason for not stealing power from both is probably because furnaces and thermostats are made by different companies and there are few industry standards for the electrical characteristics of furnace controller inputs. As a result the thermostat designer cannot count on any particular furnace configuration or installation configuration and must make the thermostat compatible with as many different configurations as possible. This includes several generations of furnaces spanning several decades. Also, many thermostats are installed by homeowners who might not have a great deal of technical expertise.

There are thermostats which can operate on the power from the furnace control board (24 VAC). This requires that a connection be made to the 24 VAC Common terminal (commonly called the C Terminal) at the furnace controller. Operating from furnace power greatly extends the lifetime of the batteries which are then only backup batteries used during power outages to save the thermostat timer program and to keep the clock running. If the microcontroller in the thermostat contains non-volatile memory for storing the timer program then the batteries are needed only to keep the clock running.

There are thermostats, such as Wi-Fi thermostats, that require furnace power because of the power demands of Wi-Fi. An example is the Honeywell RTH6500WF. (IDS Cite 7)

However, that requires an additional wire between the furnace and the thermostat. Some cables already have the extra wire. It might even already be connected appropriately. If not, it is a simple matter to connect the end of the unused wire to the 24 VAC Common terminal on the furnace controller board to bring furnace power to the thermostat.

What if the cable from the furnace to the thermostat does not have the extra wire? Running an extra wire (or new cable) might be difficult and expensive. Depending on how the home is constructed it might not even be possible other than by running an exposed cable along the walls, a practice that most people find unsightly.

If an installed cable for a furnace and air conditioning system has four wires (24 VAC, Call for Heat, Call for Cooling, and Auto/Fan) the Auto/Fan wire can be repurposed as the 24 VAC Common. The thermostat will get furnace power but the Auto/Fan feature will not be available. The Auto/Fan feature allows the homeowner to run the fan (blower) to circulate the air when the furnace or air conditioning is not running and many homeowners consider this a valuable feature.

Likewise, if an installed cable for a furnace-only system has three wires (24 VAC, Call for Heat, and Auto/Fan) the Auto/Fan wire can be repurposed as the 24 VAC Common. Again, the thermostat will get furnace power but the Auto/Fan feature will not be available.

U.S. Pat. No. 3,815,668 Comfort control system and components thereof issued Jun. 11, 1974 to Carlson teaches using polarity separation of the AC power through the thermostat to control both heating and cooling control over two wires. (IDS Cite 8) This technique is also taught by U.S. Pat. No. 4,083,397 Heating-Cooling control system issued Apr. 11, 1978 to Kimpel et al. (IDS Cite 9) U.S. Pat. No. 5,452,762 Environmental control system using poled diodes to allow additional controlled devices in existing four wire systems issued Sep. 26, 1995 to Zillner uses this technique to allow a four-wire system to control a number of extra functions such a humidifier. (IDS Cite 10) None of these patents teach providing furnace power to the thermostat or providing a backchannel to allow the furnace to send an information signal to the thermostat. See Carlson FIG. 1 (IDS Cite 8), Kimpfel Figure (IDS Cite 9), and Zillner FIG. 2 (IDS Cite 10).

Controllers for modern gas furnaces perform a number of safety checks and shut down the furnace if a fault is detected. An example is if the temperature in the combustion chamber is too high, which may be the result of a failure of the blower or even just a very clogged air filter. Another example is if the gas valve is turned on but no flame is detected within a specified period of time. Such control boards will commonly flash a repeating code on an LED to indicate the nature of the fault. For example, many Ruud/Rheem furnace controllers use the following codes (IDS Cite 11):

- 2 Flashes—Ignition failure. This failure occurs when the control does not see proper ignition given the allotted attempts and ignition cycles.
- 3 Flashes—Pressure switch fails to open.
- 4 Flashes—Pressure switch fails to close.
- 5 Flashes—Neutral polarity failure.
- 6 Flashes—ECO failure.

However, such furnace controllers do not bring an electrical error signal off-board. In order to see the LED on the furnace control board you usually have to remove the furnace panels. Even if the furnace has windows so you can see the LED without removing the panels you have to be physically at the furnace. Some furnaces are located in places like attics which are not easily accessible. Pointing either a wired or wireless camera at the LEDs on the furnace control board requires a window in the furnace cabinet to see the LEDs, a camera with an appropriate lens so the LEDs will be in focus, and room to mount the camera. It is an expensive solution, especially if an IP camera is used.

One furnace, the Rheem RGFG-Series, performs diagnostics and communicates the results to the thermostat through a wired serial link. However, this requires a proprietary thermostat. Rheem provides few technical details other than that it uses two AA batteries and it requires four house wires to connect to the furnace. {IDS Cite 12, PDF page 3}. It is currently very expensive. As of Mar. 9, 2016 it cost $357.70 (plus $4.49 shipping) on Amazon. {IDS Cite 12, PDF page 4} which is about 10 times the cost of a standard programmable thermostat.

U.S. Pat. No. 6,535,838 Furnace diagnostic system issued Mar. 18, 2003 to Abraham, et al. teaches extensive furnace diagnostics which may accessed by an infrared link to a remote handheld device or by an RS-232 interface to a modem. (IDS Cite 13) From the Abstract:

> A furnace diagnostic system includes sensors that monitor various functions of the furnace. Data generated by such sensors may be stored for subsequent transfer or may be transferred in real time via an infra red link to a remote handheld device with which an analysis thereof is performed. The handheld device additionally allows the technician to control various furnace functions to facilitate the generation of relevant real time data. In order to further enhance the system's diagnostics capabilities, the communication may be established with a centralized computing facility which includes a data base containing data relating to an entire population of similar furnaces.

Most thermostats use the defacto interface of closing contacts between the 24 VAC provided by the furnace control board and its inputs. Such functions commonly comprise: Call For Heat, Call For Cooling, and Auto/Fan. There is not even a standard for the furnace control board inputs which is why thermostats are required to provide isolated contact closures. An example of a standard thermostat is the Wright Rodgers P200. (IDS Cite 14)

OBJECTIVES AND ADVANTAGES

Therefore, there is a need to be able to provide furnace power to a thermostat where the original installation does not provide the needed extra wire and to do this without disabling any of the functions of the thermostat such as being able to run the furnace blower manually. There is a further need to provide a backchannel to allow the furnace control board to send an information signal to the thermostat to display a fault code while requiring little or no modification to the thermostat.

SUMMARY OF THE INVENTION

In a first preferred embodiment Polarity Splitting is used to allow a system with only four wires in the House Cable to provide for three thermostat functions (such as Call for Heat, Call for Cooling, Auto/Fan) as well as to provide for furnace power to the thermostat (24 VAC and 24 VAC Common).

For a thermostat whose functions consist of Call for Heat, Call for Cooling, and Auto/Fan this would normally require three wires for the three thermostat functions plus one for 24 VAC and one for 24 VAC Common for a total of five wires.

In an HVAC system with only four wires between the furnace and the thermostat the positive and negative parts of the 24 VAC are separated with diodes at the thermostat. A first thermostat function (such as Call for Heat) selects only the positive half-cycles while a second thermostat function (such as Call for Cooling) selects only the negative half-cycles. These positive and negative half-cycles are then combined onto one wire going from the thermostat to the furnace. An adapter located at the furnace uses more diodes to separate the positive and negative half-cycles.

The positive half-waves are filtered at the furnace adapter to provide a positive voltage to control a first DC relay. The contacts of this first DC relay provide the first thermostat function (such as Call for Heat) input to the furnace control board. Because this device closes switch contacts in response to positive polarity half-cycles it is called a Positive Polarity Switch. The negative half-waves are filtered to provide a negative voltage to control a second DC relay. The contacts of this second DC relay provide the second thermostat function (such as Call for Cooling) input to the furnace control board. Because this device closes switch contacts in response to negative polarity half-cycles it is called a Negative Polarity Switch.

By combining the first thermostat function (such as Call for Heat) and the second thermostat function (such as Call for Cooling) onto one wire between the thermostat and the furnace, such as the wire originally used for just the first thermostat function (such as Call for Heat), the wire originally used for the second thermostat function (such as Call for Cooling) can now be used as the 24 VAC Common. This technique is not limited to the Call for Heat and Call for Cooling thermostat functions. Polarity Splitting can be used with any two of the three thermostat functions.

This technique makes it possible to use current WiFi thermostats which require furnace power but where there would otherwise not be the number of wires available in the house wiring between the furnace and the thermostat to provide it. This technique can also be used with standard non-WiFi thermostats where it is desired to operate them from furnace power.

The second and third embodiments are for a system that either already has a sufficient number of wires between the furnace and the thermostat to provide for all of the thermostat functions as well as for providing furnace power to the thermostat (five wires) or uses Polarity Splitting as taught in the first embodiment to provide furnace power to the thermostat (four wires).

In a second preferred embodiment a single backchannel is produced by using Polarity Splitting on a wire for one of the functions such as Auto/Fan. The signal on the wire is split into positive and negative half-cycles with the negative half-cycle used by the Auto/Fan switch at the thermostat. At the furnace adapter the negative half-waves are filtered to provide a negative voltage to control a DC relay. The contacts of this DC relay provide the Auto/Fan input to the furnace controller. Because this device closes switch contacts in response to negative polarity half-cycles it is called a Negative Polarity Switch.

The positive half-cycle is used by circuitry at the furnace adapter. This circuitry is responsive to the Diagnostic LED on the furnace control board and sends its status on positive half-cycles on the Auto/Fan wire thus providing a backchannel to the thermostat adapter. At the thermostat adapter the positive half-cycles are detected and used to turn on an LED which will show the state of the Diagnostic LED on the furnace control board. When the Diagnostic LED on the furnace control board flashes, the remote LED at the thermostat will flash with it. An LED on the furnace adapter also allows the state of the Diagnostic LED on the furnace control board to be seen without opening up the furnace.

The furnace adapter is able to determine the state of the Diagnostic LED on the furnace control board either by a direct electrical connection using an optocoupler for electrical isolation or by using a phototransistor that is physically mounted so as to look at the Diagnostic LED. This can be accomplished by mounting the phototransistor at one end of a short flexible tube with the other end of the tube fitted over the Diagnostic LED. As an alternative the state of the Flame Good LED can be used instead of the Diagnostic LED.

Thus, a backchannel is created allowing the furnace to send information to the thermostat while preserving the existing thermostat functions and without requiring an extra wire between the furnace and the thermostat.

In a third preferred embodiment two or more backchannels are produced by using Polarity Splitting on a wire for one of the functions such as Auto/Fan. The signal on the wire is split into positive and negative half-cycles with the negative half-cycle used by the Auto/Fan switch at the thermostat. At the furnace adapter the negative half-waves are filtered to provide a negative voltage to control a DC relay. The contacts of this DC relay provide the Auto/Fan input to the furnace controller. Because this device closes switch contacts in response to negative polarity half-cycles it is called a Negative Polarity Switch.

Where the third embodiment differs from the second embodiment is that the period of the positive half-cycle is divided into two or more time periods (time slots) during which the furnace adapter may produce two or more pulses separated in time, each one constituting a backchannel from the furnace to the thermostat. For example, with two backchannels the backchannel allocated to the first time slot may be responsive to the Diagnostic LED on the furnace control board and the backchannel allocated to the second time slot period may be responsive to the Flame Good LED on the furnace control board. The circuitry at the thermostat adapter looks for the presence of the pulses during the positive half-cycles. The production of the pulses at the furnace adapter and the detection of the pulses at the thermostat adapter may be done using discrete logic or by an inexpensive microcontroller such as the Texas Instruments MSP430G2211.

The furnace adapter is able to determine the state of the Diagnostic LED on the furnace control board either by a direct electrical connection using an optocoupler for electrical isolation or by using a phototransistor that is physically mounted so as to look at the Diagnostic LED. This can be accomplished by mounting the phototransistor at one end of a short flexible tube with the other end of the tube fitted over the Diagnostic LED. The state of the Flame Good LED is determined using the same methods used for the Diagnostic LED. LEDs on the furnace adapter allows the states of the Diagnostic LED and Flame Good LED on the furnace control board to be seen without opening up the furnace.

As an alternative the furnace control board can incorporate the functions of the furnace adapter. Also as an alternative functions of the thermostat adapter and be incorporated by the thermostat itself.

Thus, two backchannels are created allowing the furnace to send information to the thermostat while preserving the existing thermostat functions and without requiring extra wires between the furnace and the thermostat.

In a fourth preferred embodiment the communications between the furnace adapter and the thermostat adapter is done entirely through the use of an asynchronous serial link (such as with a UART) using a single data line (half-duplex). The furnace adapter also receives the data it is transmitting and then compares the two. If the data received is not the same as the data transmitted then it means that a data collision has occurred because the thermostat adapter has sent data at the same time. If that happens then the furnace adapter waits a specified first time period and retransmits the data.

Similarly the thermostat adapter also receives the data it is transmitting and then compares the two. If the data received is not the same as the data transmitted then it means that a data collision has occurred because the furnace adapter has sent data at the same time. If that happens then the thermostat adapter waits a specified second time period and retransmits the data. The second time period for the thermostat adapter is different from the first time period for the furnace adapter to prevent another data collision from happening.

This technique provides a number of backchannels from the furnace to the thermostat. These backchannels may be used for the Diagnostic LED and Flame Good LED on the furnace controller. They may also be used for other purposes by adding sensors to the furnace to monitor its operation such as an air flow sensor. A change in the air flow would indicate that the filter is becoming clogged and needs to be replaced. In a gas furnace a gas detector would indicate a serious furnace failure, as would a carbon monoxide detector. Such detectors would provide the homeowner with advance warning of dangerous conditions.

In this embodiment the power supplied to the Thermostat Adapter can be DC instead of AC. For 24 VAC furnace power this would be about 36 VDC. This DC voltage is already available on the furnace adapter and makes the diode and filter capacitor on the thermostat adapter unnecessary. However, it requires that the power circuitry in the thermostat use a positive half-wave diode and filter capacitor. Also, it might not be suitable for thermostats that use power-stealing.

In another variation of the fourth preferred embodiment the communications between the furnace adapter and the thermostat adapter is also done entirely through the use of an asynchronous serial link (such as with a UART) using a single data line (half-duplex). However, the UART data from the Furnace Adapter is sent (and received by the Thermostat Adapter) only during positive half-cycles of the furnace power and the UART data from the Thermostat Adapter is sent (and received by the Furnace Adapter) only during negative half-cycles of the furnace power. Naturally, the positive and negative half-cycles could be switched so that the UART data from the Furnace Adapter is sent (and received by the Thermostat Adapter) only during negative half-cycles of the furnace power and the UART data from the Thermostat Adapter is sent (and received by the Furnace Adapter) only during positive half-cycles of the furnace power.

This eliminates the possibility of data collisions and makes it possible to use a microcontroller without a hardware UART by implementing the UART in software. However, it requires a small amount of extra circuitry and board space in both the Furnace Adapter and the Thermostat Adapter.

For a robust design the furnace adapter may require a number of consecutive identical commands from the thermostat adapter (such as for Call for Heat) in order to validate the command. A reasonable number of consecutive identical commands is four.

An example of an inexpensive microcontroller with a hardware UART is the Texas Instruments MSP430G2553.

This technique requires only three wires: two for furnace power (24 VAC and 24 VAC Common), and one for Data.

In order to allow this technique to be used with thermostats that do power-stealing the thermostat adapter may contain one or more resistors to represent the loads presented by a furnace controller.

As a result any standard thermostat may be used with the system, providing furnace power and a number of backchannels from the furnace to the thermostat, even when there are only three house wires.

In a fifth preferred embodiment two wires in the cable from the furnace to the thermostat provide furnace power to a Wi-Fi enabled thermostat. The Wi-Fi thermostat constitutes a first Wi-Fi node.

A furnace adapter containing a second Wi-Fi node is located at the furnace and is powered by furnace power. The furnace adapter communicates with the Wi-Fi thermostat which issues thermostat commands to the furnace adapter which provides contact closures to the existing furnace controller. These furnace commands may include standard commands such as Call for Heat, Call for Cooling, and Auto/Fan.

Through the appropriate instrumentation the furnace adapter may observe, log, and timestamp every operation of the furnace such as startups and shutdowns. For example, did the gas valve open (or close) within the proper amount of time? Did the Flame Sensor detect a flame in the normal amount of time or was it slow? Is the air flow normal or is the air filter becoming clogged? Is the blower drawing more current than normal? It might mean a clogged air filter or it might mean that the blower is starting to fail.

The second Wi-Fi node (located at the furnace) should preferably support Wi-Fi Direct so that it can communicate directly with the Wi-Fi thermostat without requiring a separate wireless router in the home. (Wi-Fi Direct is a Wi-Fi standard enabling devices to easily connect with each other without requiring a wireless access point. See IDS Cite 15) By supporting Wi-Fi Direct the data from the furnace controller can also be accessed directly from a Tablet or a Wi-Fi enabled smart cell phone by running the appropriate App.

In such a system Wi-Fi security is critical. However, if the Wi-Fi thermostat is secure enough to accept user commands (and programs) it is secure enough to issue commands to the furnace. If the Wi-Fi isn't secure enough to issue commands to the furnace then it isn't secure enough to accept user commands (and programs).

It should be appreciated that the furnace controller in the fifth embodiment is smart enough to also contain and implement any programmed HVAC schedule that the homeowner desires and also has the communications capability needed to allow the homeowner to specify the HVAC schedule from Wi-Fi enabled devices such as Tablets, Wi-Fi enabled smart cell phones or conventional computers through a wireless router.

Therefore, in a sixth preferred embodiment, the Wi-Fi thermostat in the fifth embodiment is dispensed with. In addition to the functions performed by the furnace adapter in the fifth embodiment the furnace adapter in the sixth embodiment also performs all of the functions that had been performed by the Wi-Fi thermostat, such as thermostat programming of time and temperature settings. The Wi-Fi thermostat on the wall can be replaced with only a temperature sensor. It may also contain a humidity sensor so the furnace adapter can use the humidity to calculate a Comfort Factor in controlling the Heat, Cooling, and Fan functions of the HVAC system. The sensor at the wall can also contain basic thermostat functions to be used only if the Wi-Fi link fails. Connection to the furnace adapter can be made by the three-wire serial link taught in the fourth embodiment.

Further, the Furnace Controller can perform continuous diagnostics of its system and keep a time-stamped log of any failures or anomalies. Anomalies may also comprise the reading of parameters which, although they do not constitute a current failure, may predict a future failure and warn the User. For example, if a flame sensor monitor is trending toward failure the User can take proactive steps and not wait until the flame sensor fails. The failure of a flame sensor will keep the furnace from operating and is a common cause of furnace failures. The User does not have to proactively monitor the furnace. In a home with a wireless router and an Internet connection the furnace can send an email if something is going wrong and needs attention before it fails. Or the furnace can send an email to a preferred HVAC company to tell them that something is starting to go bad, and they can contact the User using email, texting, or even an old fashioned voice phone call. There are a number of companies that offer VOIP-to-landline service. The furnace can have a speech synthesizer and call the User on the phone. In addition, if the User is someone who needs some help in order to live independently the furnace can contact a friend or relative if it needs attention. All of the above comments apply equally to air conditioning.

Therefore, in a sixth preferred embodiment the thermostat is dispensed with and replaced with only a remotely located temperature sensor. A humidity sensor is optional.

DETAILED DESCRIPTION

In the following description, numerous specific details are set forth to provide a thorough understanding of the invention. However, it is understood that the invention may be practiced without these specific details. In other instances well-known circuits, structures, and techniques have not been shown in detail in order not to obscure the invention.

The first embodiment uses Polarity Splitting to allow a system with only four wires in the House Cable to provide for three thermostat functions (such as Call for Heat, Call for Cooling, Auto/Fan) as well as to provide for furnace power to the thermostat (24 VAC and 24 VAC Common).

Figure 1:
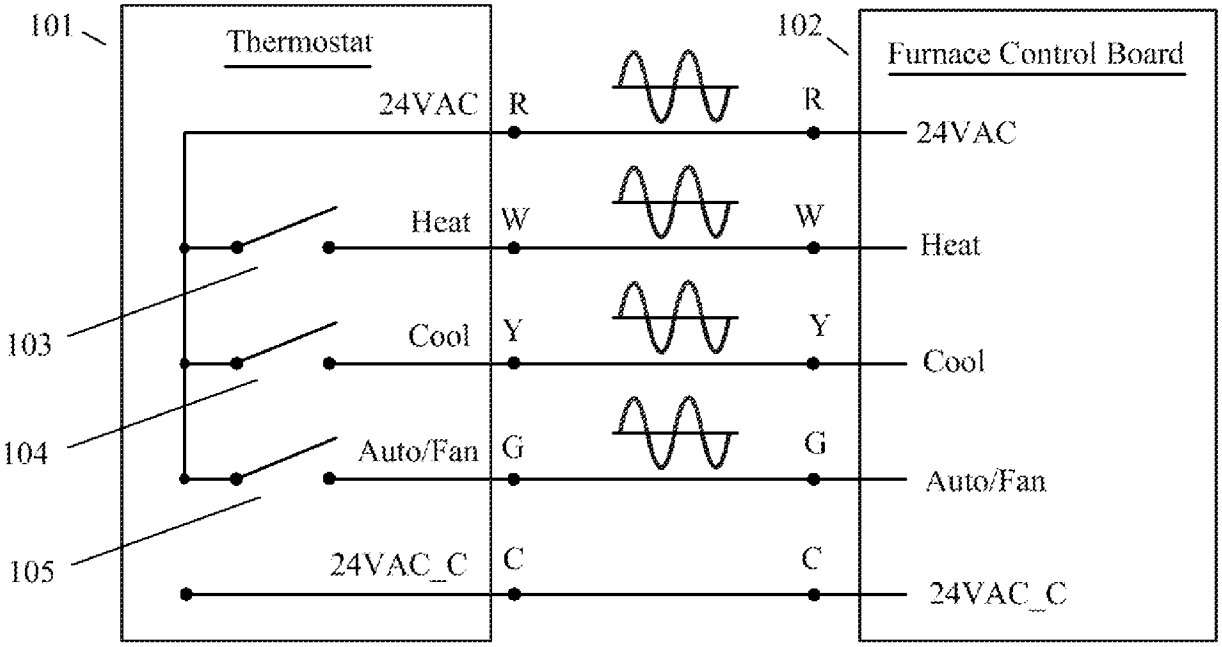
FIG. 1 is a general illustration showing the electrical circuit for a system with five wires connecting a thermostat and a furnace controller to provide three thermostat functions as well as furnace power to the thermostat.
Figure 2:
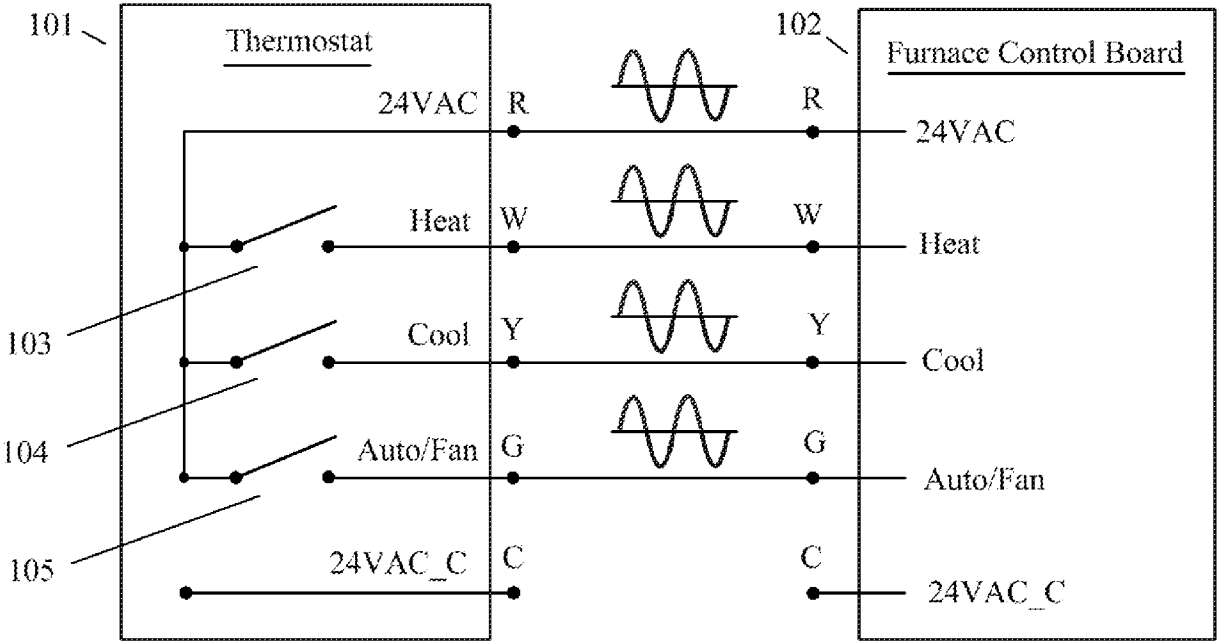
FIG. 2 is a general illustration showing the electrical circuit for a system with four wires connecting a thermostat and a furnace controller to provide three thermostat functions but no furnace power to the thermostat.

FIG. 1 shows a system that requires five wires. Thermostat 101 provides three functions: Call for Heat with switch 103, Call for Cooling with switch 104, and Auto/Fan with switch 105. Switch 103 and switch 104 are controlled by Thermostat 101. Switch 105 is a manual switch which allows the User to manually turn on the HVAC blower. Furnace power is provided to Thermostat 101 on the 24 VAC line ("R") and the 24 VAC Common line ("C"). Furnace power is supplied by Furnace Control Board 102 which is responsive to the signals from Thermostat 101: Call for Heat, Call for Cooling, and Auto/Fan.

Where there are only four wires in the House Cable it is possible to retain the three thermostat functions by using a thermostat that runs on batteries and/or uses Power Stealing. See FIG. 2. However, some thermostats, such as some Wi-Fi thermostats, require furnace power in order to work.

Figure 3:
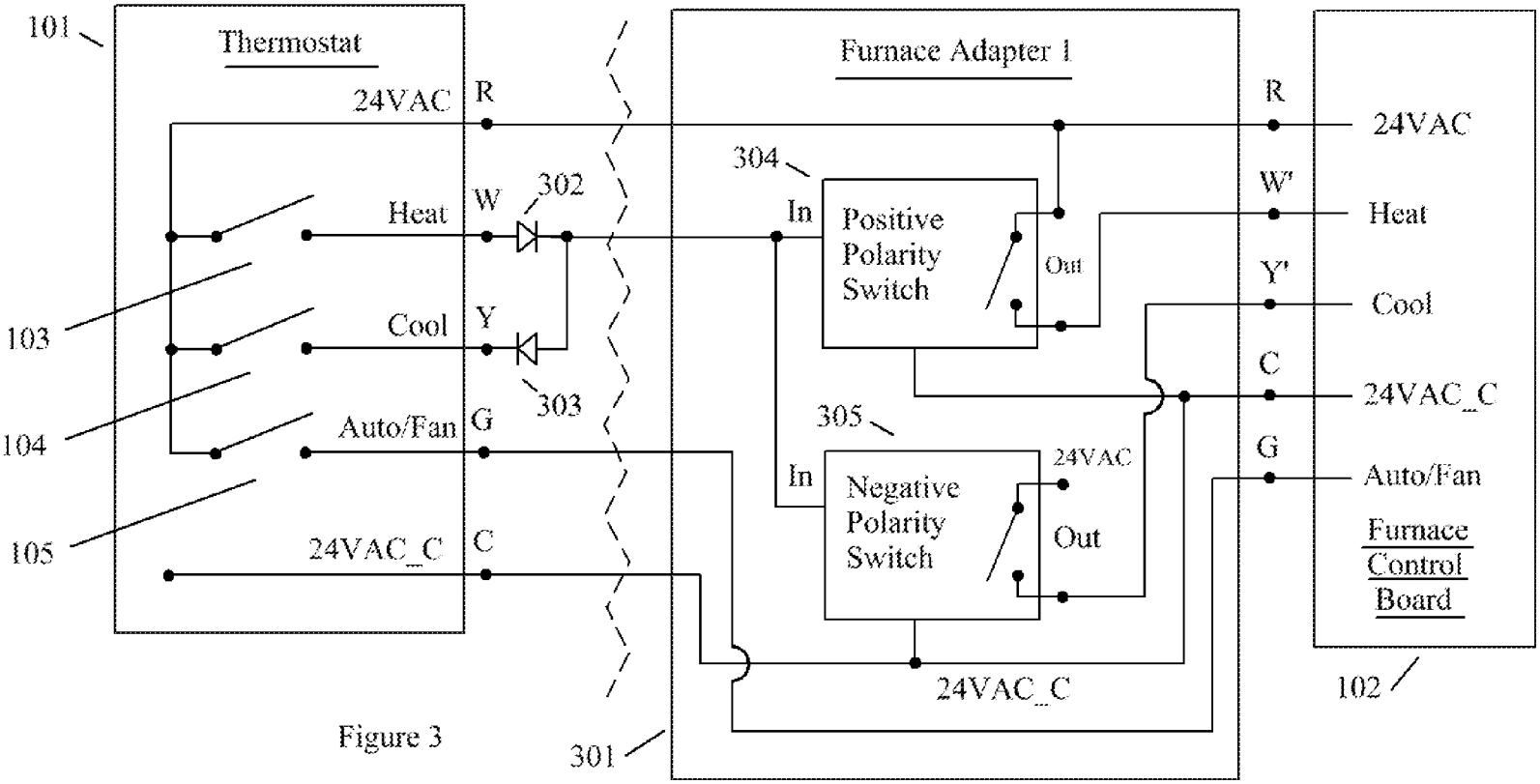
FIG. 3 is a general illustration showing the electrical circuit for a system with four wires where Polarity Splitting is used to retain the three thermostat functions as well as to provide furnace power to the thermostat using Adapter 1 which is used in the first embodiment.

FIG. 3 shows how Polarity Splitting allows a system with only four wires in the House Cable to provide for three thermostat functions (such as Call for Heat, Call for Cooling, Auto/Fan) as well as to provide for furnace power to the thermostat (24 VAC and 24 VAC Common).

At Thermostat 101 the Call for Heat (W) uses diode 302 to produce only positive half-cycles of the 24 VAC power. The Call for Cooling (Y) uses diode 303 to produce only negative half-cycles of the 24 VAC power. They are combined onto the house wire that had been used only for Call for Heat. Since the positive half-cycles and negative half-cycles come from the same 24 VAC they are guaranteed to be separated in time. They could also both be used together, although having the Heat and Cooling on at the same time is generally counterproductive.

Figure 4A:
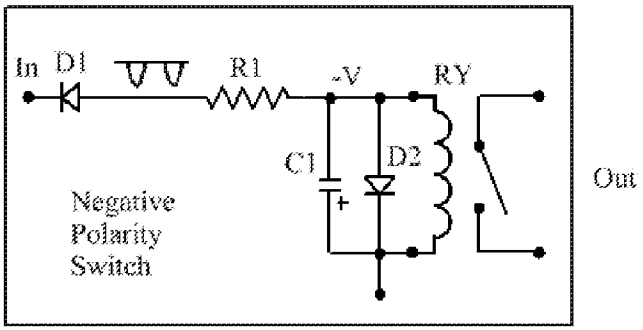
FIG. 4A is a general illustration showing the electrical circuit details for a Positive Polarity Switch.

At Furnace Adapter 1 (301) Positive Polarity Switch 304 filters the positive half-waves to provide a positive voltage to control a first DC relay. The contacts of this first DC relay provide the Call for Heat thermostat function to the furnace control board input. The details of Positive Polarity Switch 304 are shown in FIG. 4A.

Figure 4B:
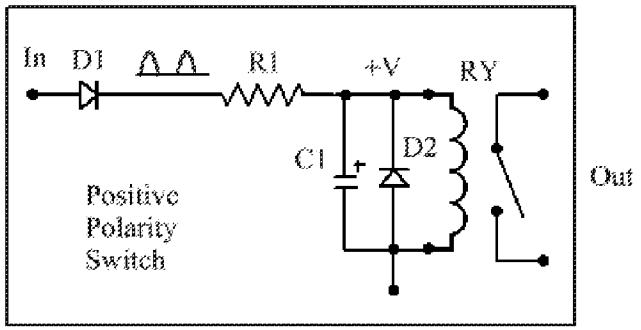
FIG. 4B is a general illustration showing the electrical circuit details for a Negative Polarity Switch.

Negative Polarity Switch 305 filters the negative half-waves to provide a negative voltage to control a second DC relay. The contacts of this second DC relay provide the Call for Cooling thermostat function to the furnace control board input. The details of Negative Polarity Switch 305 are shown in FIG. 4B.

The wire that had been used for Call for Cooling (Y) is now available and is repurposed as the 24 VAC Common (C) wire.

Thus Polarity Splitting allows a system with only four wires in the House Cable to provide for three thermostat functions (such as Call for Heat, Call for Cooling, Auto/Fan) as well as to provide for furnace power to the thermostat (24 VAC and 24 VAC Common).

Figure 4C:
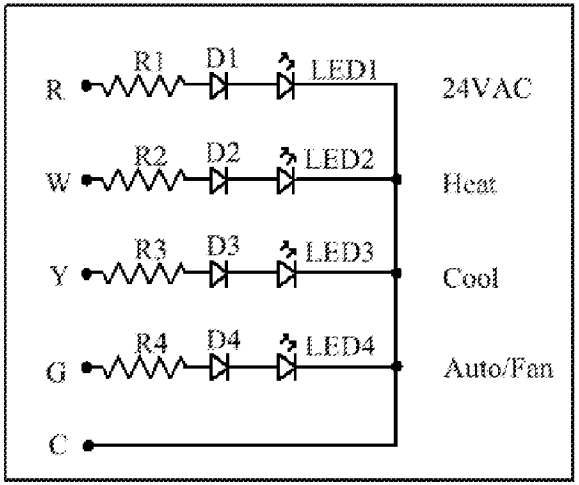
FIG. 4C is a general illustration showing the electrical circuit details for an LED display of the thermostat commands.

FIG. 4C shows a useful extra feature that can be added by putting LED indicators on the lines going to Furnace Control Board 102. Thermostats are generally located at some distance from the furnace and there is no point in troubleshooting the furnace if the thermostat is not providing the proper control signals.

Figure 5:
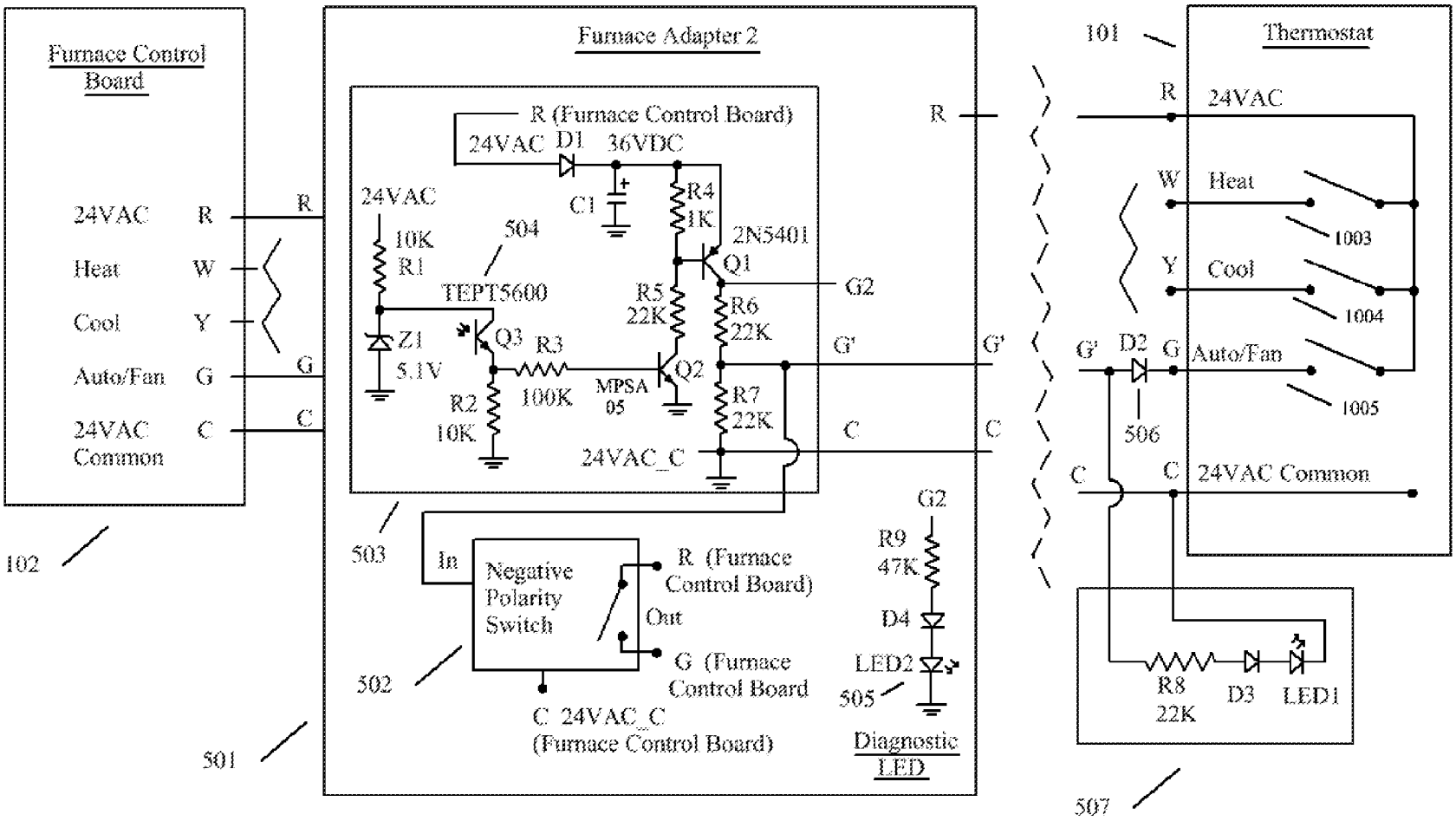
FIG. 5 is a general illustration showing the electrical circuit for Adapter 2 in the second embodiment which provides for a single backchannel from the furnace to the thermostat.

The second embodiment provides for a single backchannel from the furnace to the thermostat. See FIG. 5.

On Thermostat 101 Polarity Splitting is used on the Auto/Fan function. Diode 506 causes the Auto/Fan function to use only the negative half-cycles. At Furnace Adapter 2 (501) the Negative Polarity Switch 502 filters the negative half-waves to provide a negative voltage to control a DC relay. The contacts of this DC relay provides the Auto/Fan function to the furnace control board input.

The positive half-cycles are used to provide a backchannel to Thermostat 101. The object of the backchannel is to be able see the state of the Diagnostic LED on the furnace control board from Thermostat 101. This starts with Phototransistor 504 which is positioned to see the Diagnostic LED on the furnace control board. When the Diagnostic LED on the furnace control board is on, Circuit 503 produces positive pulses during the positive half-cycles on house wire G'.

At Thermostat 101 the positive pulses during the positive half-cycles on house wire G' activate the LED circuit 507. Since circuit 507 responds only to positive voltages it ignores the negative half-cycles produced by Auto/Fan thermostat switch 1005 and Diode 506. Likewise, the Negative Polarity Switch 502 ignores the positive voltage produced by circuit 503 on Furnace Adapter 2.

The Heat (W) and Cool (Y) inputs on Furnace Control Board 102 can be connected to the Heat (W) and Cool (Y) signals on Thermostat 101 either with their own separate wires or by using a single wire using Polarity Splitting as taught in the first embodiment.

Thus, the second embodiment uses Polarity Splitting to preserve the existing thermostat functions while providing a useful backchannel that allows the state of the Diagnostic LED on the furnace control board to be seen at the thermostat.

A useful extra feature can be added by circuit 505 which puts an LED indicator on Furnace Adapter 2 that also allows the state of the Diagnostic LED on the furnace control board to be seen at Furnace Adapter 2. When Furnace Adapter 2 is located outside of the furnace it allows the state of the Diagnostic LED to be seen without removing the furnace panels.

The third embodiment provides for two or more backchannels from the furnace to the thermostat. As in the second embodiment Polarity Splitting is used on the Auto/Fan switch at the thermostat to use the negative polarity of the signal and a Negative Polarity Switch is used on the Furnace Control Board. Where the third embodiment differs from the second embodiment is that the period of the positive half-cycle is divided into two or more time periods during which the furnace adapter may produce two or more pulses separated in time, each one constituting a backchannel from the furnace to the thermostat. For example, with two backchannels the backchannel allocated to the first data period may be responsive to the Diagnostic LED on the furnace control board and the backchannel allocated to the second data period may be responsive to the Flame Good LED on the furnace control board. The circuitry at the thermostat adapter looks for the presence of the data during the positive half-cycles. The production of the data at the furnace adapter and the detection of the data at the thermostat adapter will be done using an inexpensive microcontroller, the Texas Instruments MSP430G2211. As an alternative it could instead be done using discrete logic.

Figure 7:
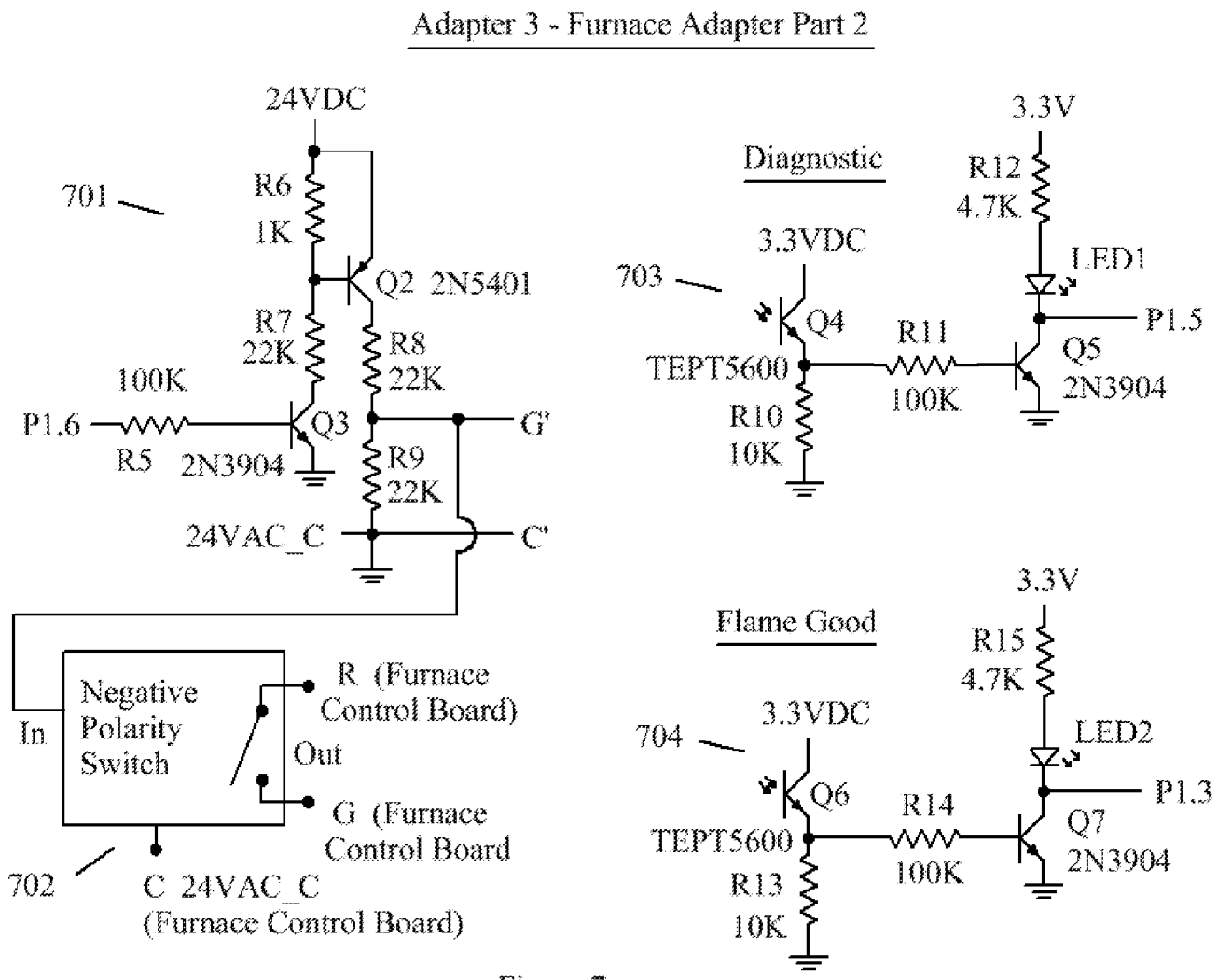
FIG. 7 is a general illustration showing the electrical circuit for Adapter 3—Furnace Adapter—Part 2 which is used in the third embodiment to provide for two or more backchannels from the furnace to the thermostat.
Figure 9:
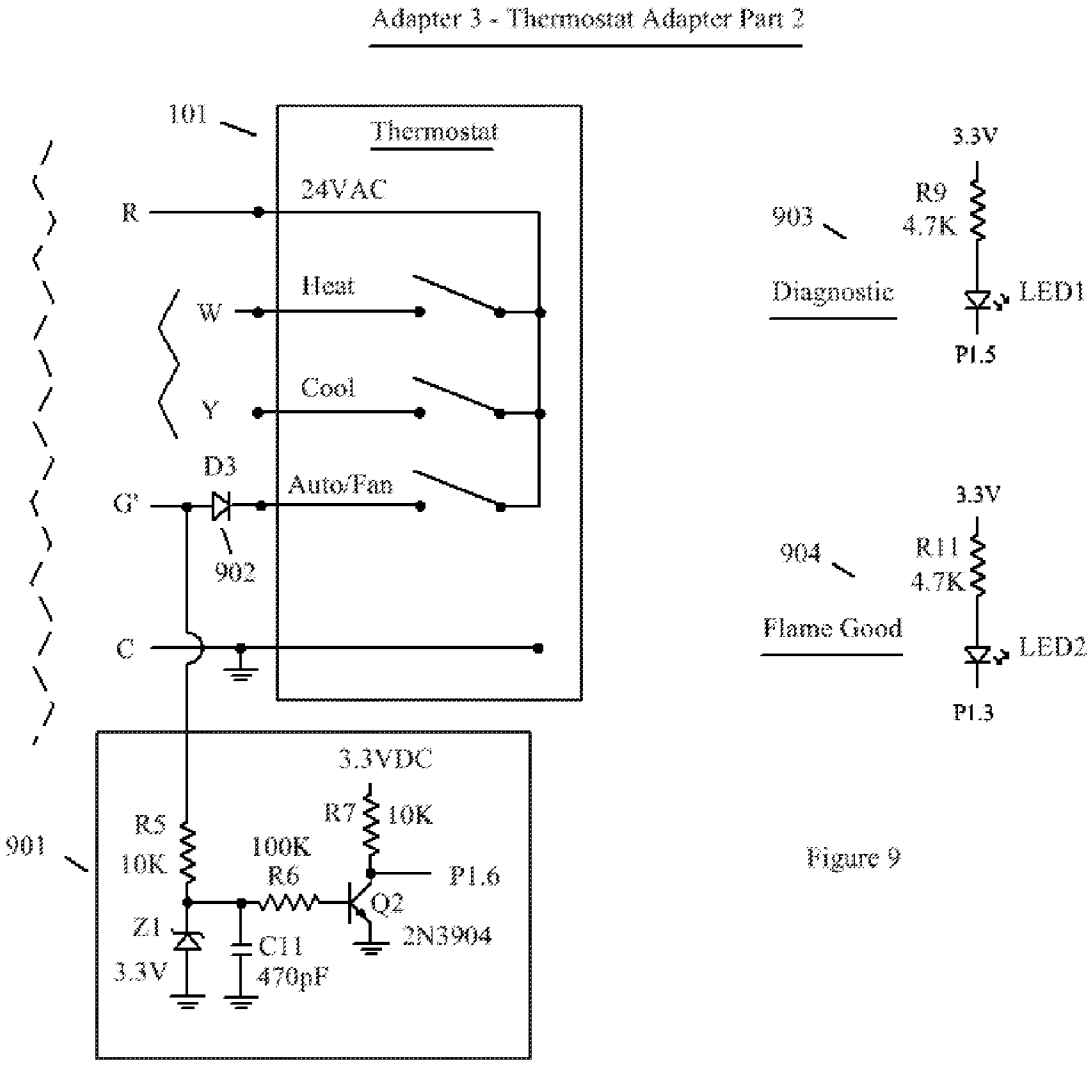
FIG. 9 is a general illustration showing the electrical circuit for Adapter 3—Thermostat Adapter—Part 2 which is used in the third embodiment to provide for two or more backchannels from the furnace to the thermostat.

In FIG. 9, on Thermostat 101, Polarity Splitting is used on the Auto/Fan function. Diode 902 causes the Auto/Fan function to use only the negative half-cycles. At Furnace Adapter 3 Part 2 (FIG. 7) the Negative Polarity Switch 702 filters the negative half-waves to provide a negative voltage to control a DC relay. The contacts of this DC relay provides the Auto/Fan function to the furnace control board input.

Figure 6:
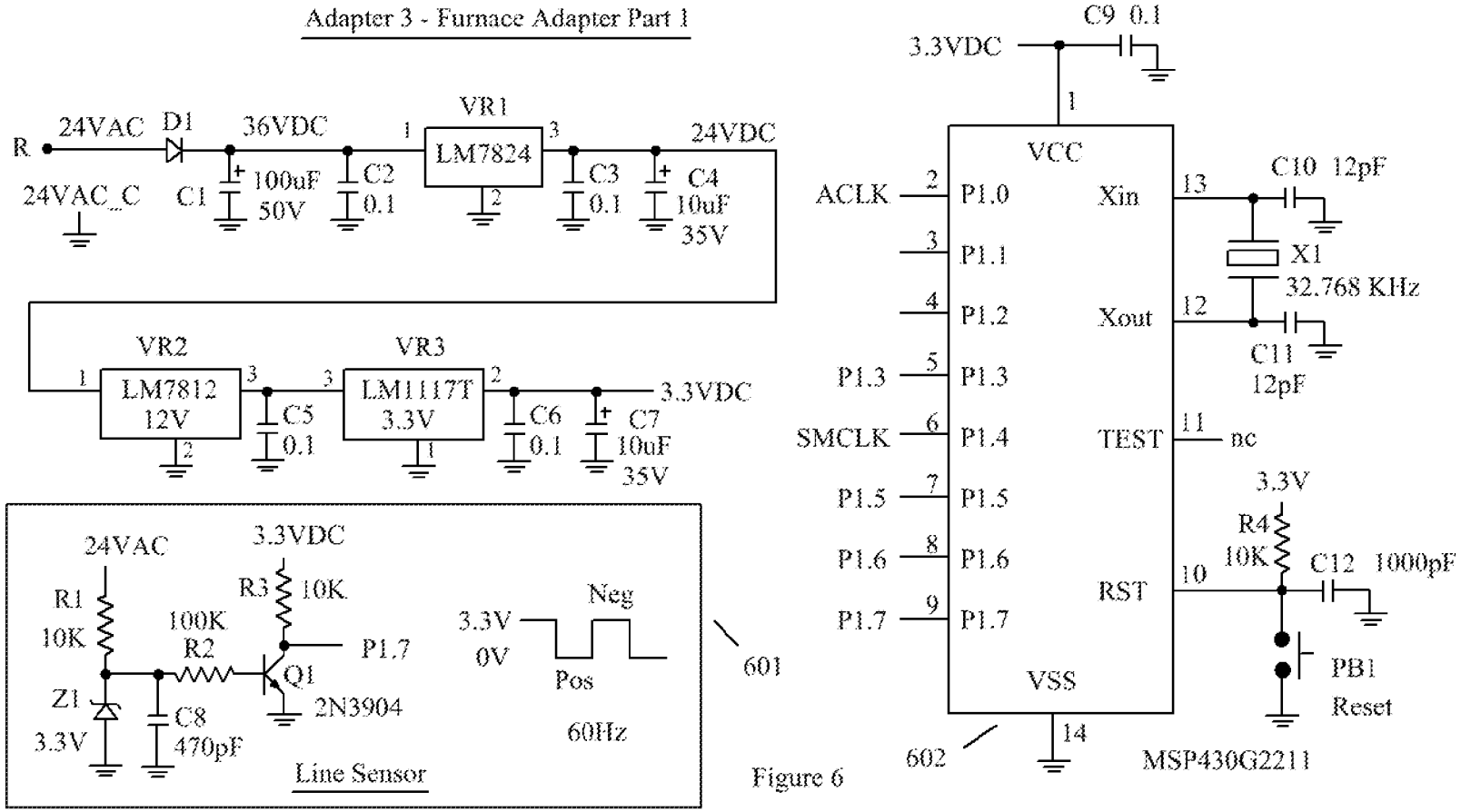
FIG. 6 is a general illustration showing the electrical circuit for Adapter 3—Furnace Adapter—Part 1 which is used in the third embodiment to provide for two or more backchannels from the furnace to the thermostat.

On Furnace Adapter 3 Part 1 (FIG. 6) the Line Sensor 601 determines the polarity of 24 VAC half-cycle and sends it to Microcontroller 602 (FIG. 6).

On Furnace Adapter 3 Part 2 (FIG. 7) Circuit 703 uses a phototransistor to look at the Diagnostic LED on the Furnace Control Board and sends its state to Microcontroller 602 (FIG. 6).

On Furnace Adapter 3 Part 2 (FIG. 7) Circuit 704 uses a phototransistor to look at the Flame Good LED on the Furnace Control Board and sends its state to Microcontroller 602 (FIG. 6).

Microcontroller 602 (FIG. 6) uses the signal from Line Sensor 601 to wait for the beginning of the positive half-cycle. If Circuit 703 (FIG. 7) has detected that the Diagnostic LED on the Furnace Control Board is on, then Microcontroller 602 (FIG. 6) uses Circuit 701 (FIG. 7) to put a positive voltage on House Wire G' for approximately 3 ms (the first data period). If Circuit 703 (FIG. 7) has not detected that Diagnostic LED on the Furnace Control Board is on, then Microcontroller 602 (FIG. 6) uses Circuit 701 (FIG. 7) puts zero voltage on House Wire G' for approximately 3 ms.

If Circuit 704 (FIG. 7) has detected that the Flame Good LED on the Furnace Control Board is on, then Microcontroller 602 (FIG. 6) uses Circuit 701 (FIG. 7) to put a positive voltage on House Wire G' for the next approximately 3 ms (the second data period). If Circuit 704 (FIG. 7) has not detected that the Flame Good LED on the Furnace Control Board is on, then Microcontroller 602 (FIG. 6) uses Circuit 701 (FIG. 7) puts zero voltage on House Wire G' for the next approximately 3 ms.

Figure 8:
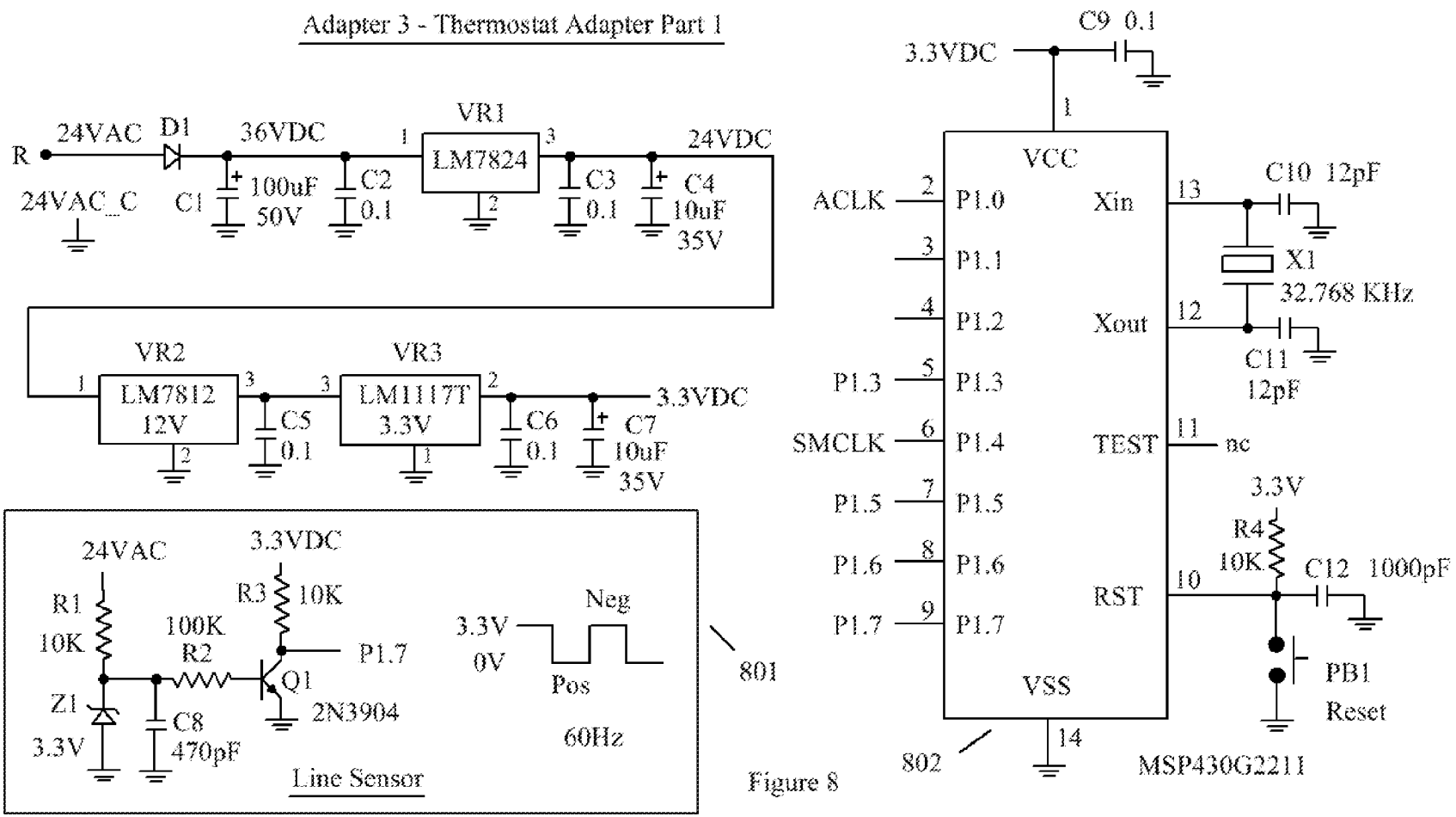
FIG. 8 is a general illustration showing the electrical circuit for Adapter 3—Thermostat Adapter—Part 1 which is used in the third embodiment to provide for two or more backchannels from the furnace to the thermostat.

On Thermostat Adapter 3 Part 1 (FIG. 8) the Line Sensor 801 determines the polarity of 24 VAC half-cycle and sends it to Microcontroller 802. Circuit 902 (FIG. 9) detects the state of House Line G' and sends it to Microcontroller 802 (FIG. 8).

Microcontroller 802 (FIG. 8) uses the signal from Line Sensor 801 to wait for the beginning of the positive half-cycle and then waits for approximately 1.5 ms for the middle of the first data period from Microcontroller 601 (FIG. 6). Then it reads the signal from Circuit 902 (FIG. 9). If the signal is high, then it means that the Diagnostic LED on the Furnace Control Board is on so Microcontroller 802 (FIG. 8) turns on its Diagnostic LED indicator 903 (FIG. 9). If the signal from Circuit 902 (FIG. 9) is low then it means that the Diagnostic LED on the Furnace Control Board is off so Microcontroller 802 (FIG. 8) turns off its Diagnostic LED indicator 903 (FIG. 9).

Microcontroller 802 (FIG. 8) then waits approximately 3 ms for the middle of the second data period from Microcontroller 601 (FIG. 6). Then it reads the signal from Circuit 902 (FIG. 9). If the signal is high, then it means that the Flame Good LED on the Furnace Control Board is on so Microcontroller 802 (FIG. 8) turns on its Flame Good LED indicator 904 (FIG. 9). If the signal from Circuit 902 (FIG. 9) is low then it means that the Flame Good LED on the Furnace Control Board is off so Microcontroller 802 (FIG. 8) turns off its Flame Good LED indicator 904 (FIG. 9).

The Heat (W) and Cool (Y) inputs on the furnace control board can be connected to the Heat (W) and Cool (Y) signals on Thermostat 101 either with their own separate wires or by using a single wire using Polarity Splitting as taught in the first embodiment.

The source code for implementing the third embodiment is reproduced in Appendix A for the Furnace Adapter 3 (FIGS. 6 and 7) and in Appendix B (for the Thermostat Adapter 3 (FIGS. 8 and 9). The code was compiled with Code Composer Studio 6.1.2 for use on a Texas Instruments MSP430G2 LaunchPad Version 1.4. See IDS Cite 16.

In the fourth embodiment the communications between the furnace adapter and the thermostat adapter is done entirely through the use of an asynchronous serial link (a UART) using a single data line (half-duplex). The furnace adapter also receives the data it is transmitting and then compares the two. If the data received is not the same as the data transmitted then it means that a data collision has occurred because the thermostat adapter has sent data at the same time. If that happens then the furnace adapter waits a specified first time period and retransmits the data.

Figure 10:
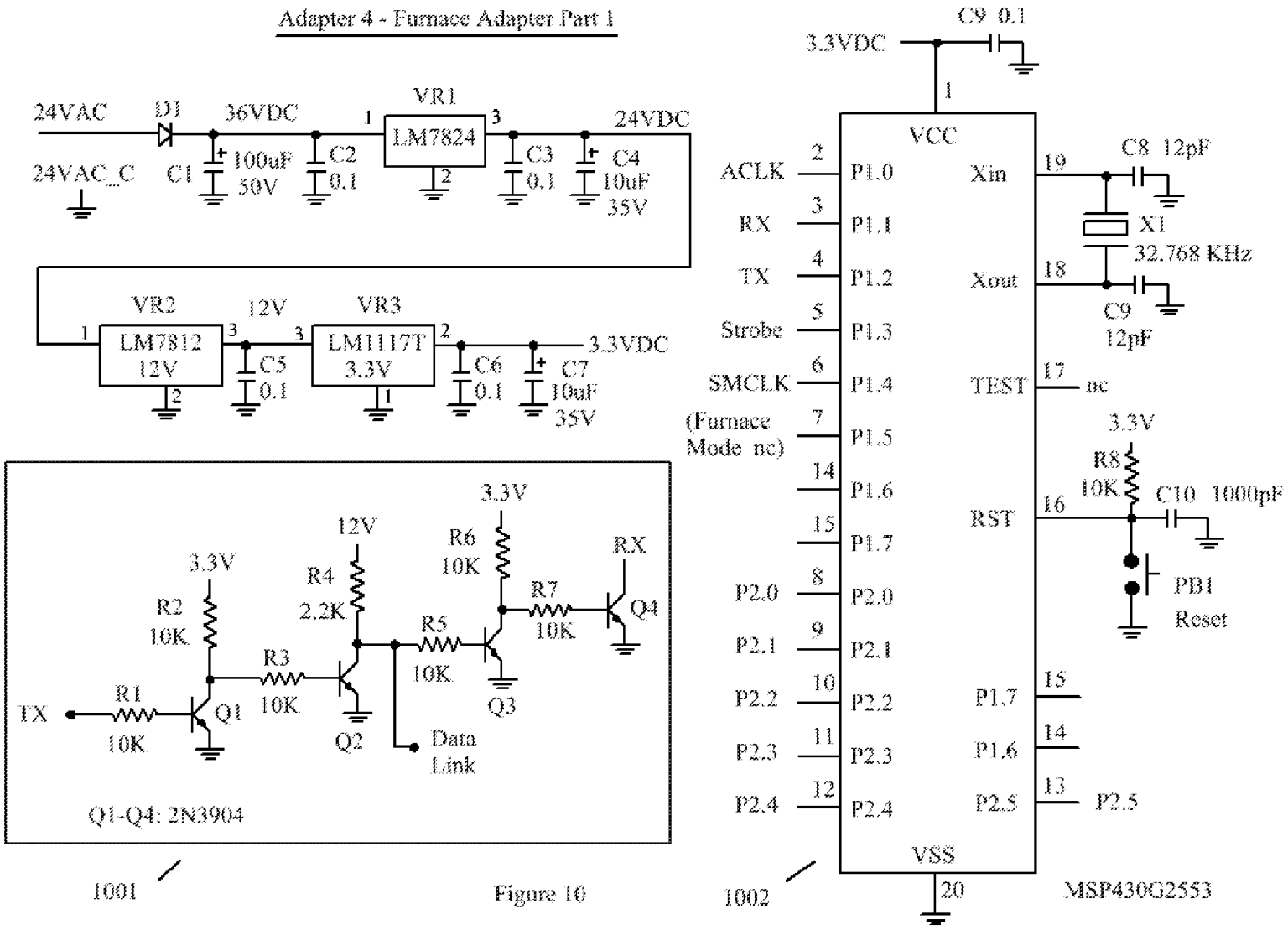
FIG. 10 is a general illustration showing the electrical circuit for Adapter 4—Furnace Adapter Part 1 used in the fourth embodiment to provide for communications between the Thermostat and the Furnace using three wires to provide a serial link with furnace power.
Figure 11:
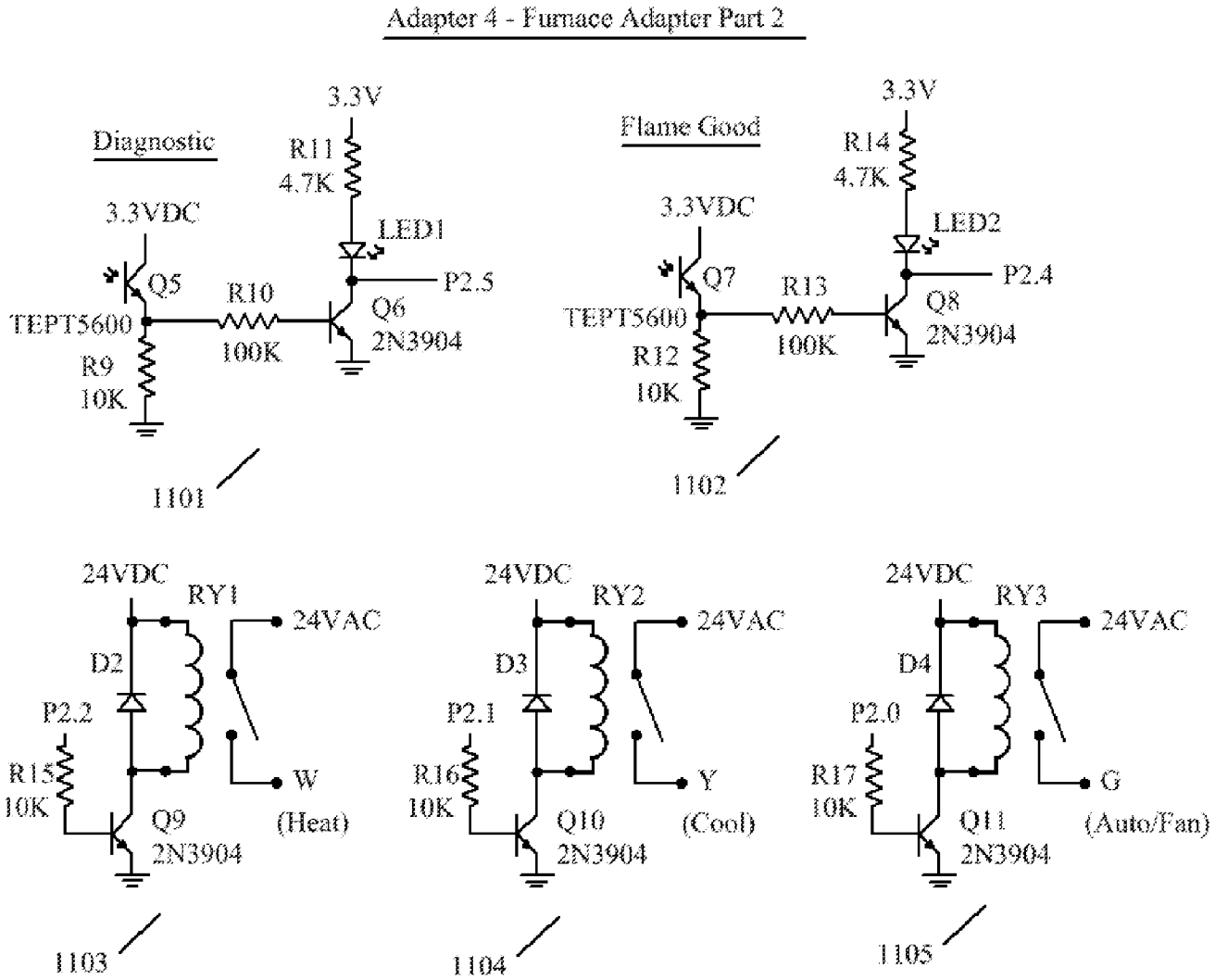
FIG. 11 is a general illustration showing the electrical circuit for Adapter 4—Furnace Adapter Part 2 used in the fourth embodiment to provide for communications between the Thermostat and the Furnace using three wires to provide a serial link with furnace power.
Figure 12:
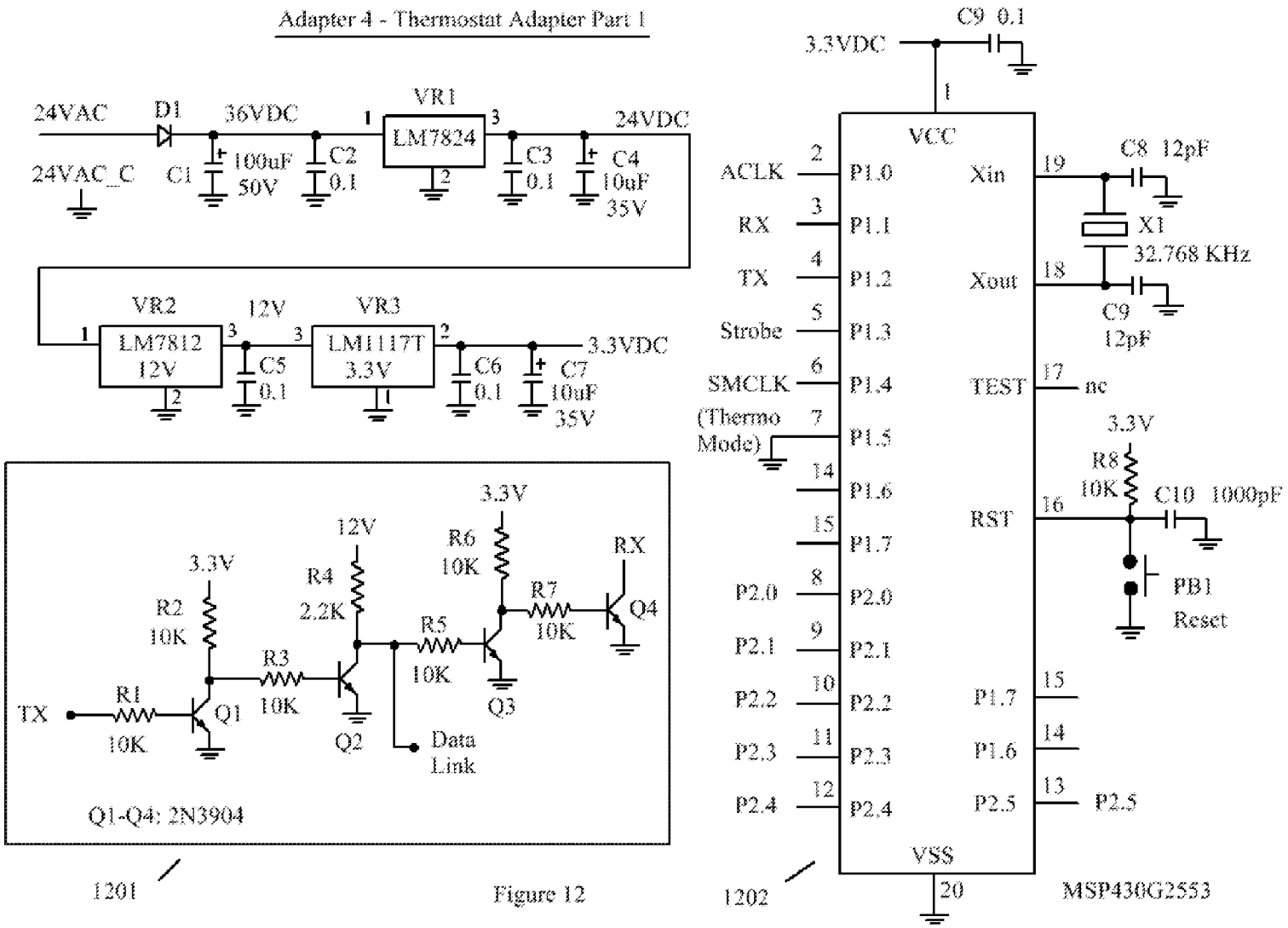
FIG. 12 is a general illustration showing the electrical circuit for Adapter 4—Thermostat Adapter Part 1 used in the fourth embodiment to provide for communications between the Thermostat and the Furnace using three wires to provide a serial link with furnace power.

In FIG. 10 (Furnace Adapter 4 Part 1) Microcontroller 1002 transmits data through Datalink 1001 which also receives the data from Datalink 1001. As a result, the UART in Microcontroller 1002 receives the data it is sending as well as the data it is receiving from Datalink 1201 (FIG. 12). In FIG. 11 (Furnace Adapter 4 Part 2) Circuit 1101 detects whether the Diagnostic LED on the Furnace Control Board is on and sends the information to Microcontroller 1002 (FIG. 10). Circuit 1102 (FIG. 11) detects whether the Flame Good LED on the Furnace Control Board is on and sends it to Microcontroller 1002 (FIG. 10). Microcontroller uses Relay Circuit 1103 to control the Call for Heat ("W") input on the Furnace Control Board input, Relay Circuit 1102 to control the Call for Cooling ("Y") input on the Furnace Control Board, and Relay Circuit 1105 to control the Auto/Fan ("G") input on the Furnace Control Board. (All on FIG. 11.)

Figure 13:
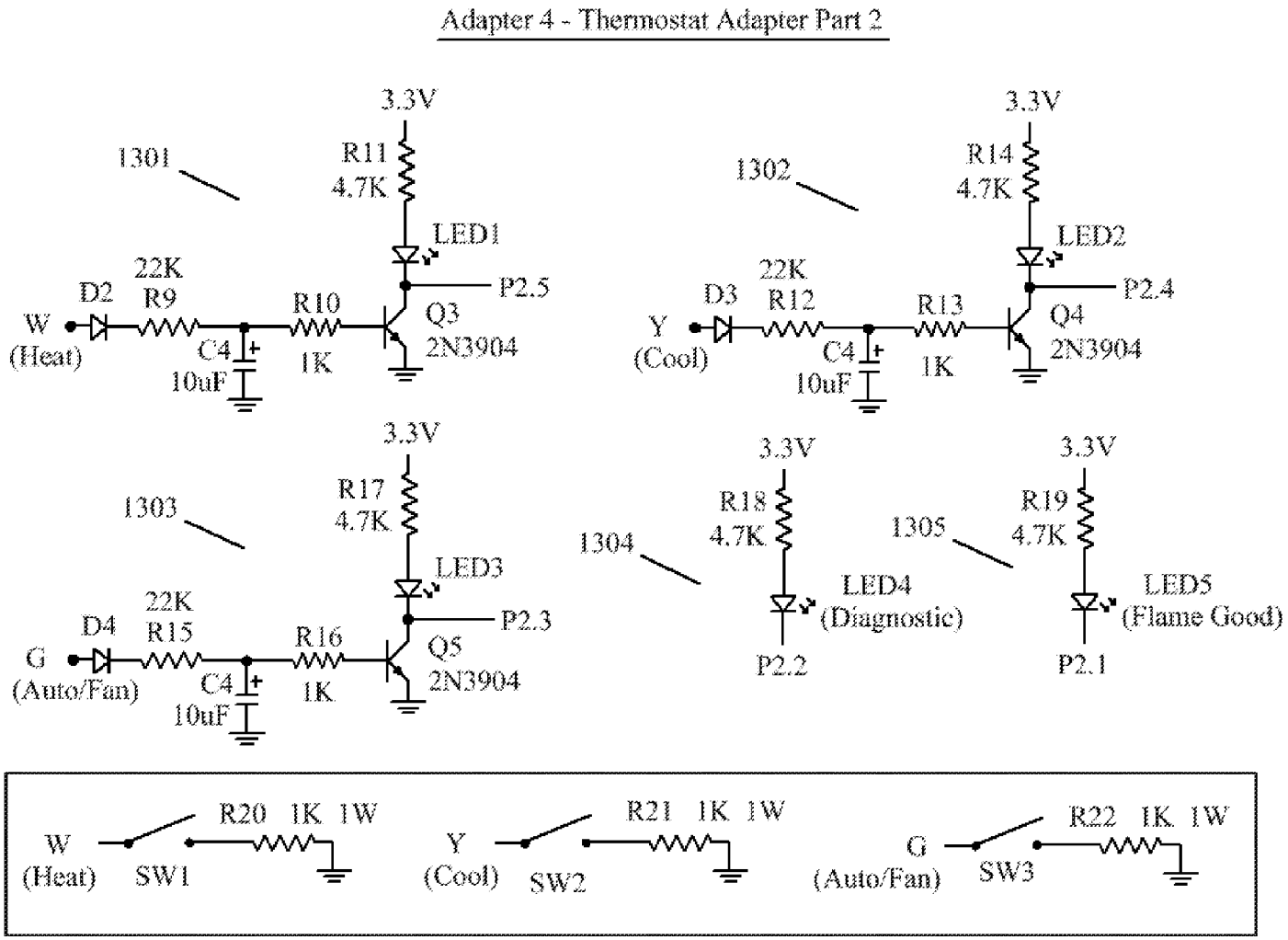
FIG. 13 is a general illustration showing the electrical circuit for Adapter 4—Thermostat Adapter Part 2 used in the fourth embodiment to provide for communications between the Thermostat and the Furnace using three wires to provide a serial link with furnace power.

In FIG. 12 (Thermostat Adapter 4 Part 1) Microcontroller 1202 transmits data through Datalink 1201 which also receives the data from Datalink 1201. As a result, the UART in Microcontroller 1202 receives the data it is sending as well as the data it is receiving from Datalink 1001 (FIG. 10). In FIG. 13 (Thermostat Adapter 4 Part 2) Circuit 1301 detects the Call for Heat command from Thermostat 1001 and sends it to Microcontroller 1202 (FIG. 12). Circuit 1302 detects the Call for Cooling command from Thermostat 1001 and sends it to Microcontroller 1202 (FIG. 12). Circuit 1303 detects the Call for Heat command from Thermostat 1001 and sends it to Microcontroller 1202 (FIG. 12).

In FIG. 13, LED Indicator 1304 is used by Microcontroller 1202 (FIG. 12) to indicate that it has received data from the Furnace Adapter 4 (FIGS. 10 and 11) that the Diagnostic LED on the Furnace Control Board is on. LED Indicator 1305 is used by Microcontroller 1202 (FIG. 12) to indicate that it has received data from the Furnace Adapter 4 (FIGS. 10 and 11) that the Flame Good LED on the Furnace Control Board is on.

In FIG. 13 Circuit 1306 contains switched load resistors for thermostats that do Power Stealing.

In operation, the UARTs in Microcontroller 1002 (FIG. 10) and Microcontroller 1202 (FIG. 12) are both programmed to operate at 4800 Baud, 8 data bits, and odd parity.

Microcontroller 1002 (FIG. 10) sends two bits of data: Diagnostic LED state and Flame Good LED state, which is received by Microcontroller 1202 (FIG. 12). When Microcontroller 12 (FIG. 12) receives the data it turns on the appropriate LED indicator: Diagnostic LED and/or Flame Good LED. This allows a User to see the status of the LEDs on the Furnace Control Board which is in the furnace and might not be easily accessible.

Microcontroller 1202 (FIG. 12) sends three bits of data (Call for Heat, Call for Cooling, and Auto/Fan) which it receives from Thermostat 101. This data is received by Microcontroller 1002 (FIG. 10). When Microcontroller 10 (FIG. 10) receives the data it turns on the appropriate relay to control the appropriate functions on the Furnace Control Board.

Since Microcontroller 1002 (FIG. 10) also receives the data that it sends, if the data received is not identical with the data that has been sent, it means that a data collision has occurred with data sent by Microcontroller 1202 (FIG. 12). Similarly, since Microcontroller 1202 (FIG. 12) also receives the data that it sends, if the data received is not identical with the data that has been sent, it means that a data collision has occurred with data sent by Microcontroller 1002 (FIG. 10).

If that happens, Microcontroller 1002 (FIG. 10) is programmed to wait a first time period (about 3 ms) before resending the data while Microcontroller 1202 (FIG. 12) is programmed to wait a second time period (about 5 ms) before resending the data. This makes it unlikely that another data collision will occur.

One of the advantages of this system is that it retains all of the thermostat's functions while providing furnace power to the thermostat and it does it with only three House Wires: 24 VAC, 24 VAC Common, and Data. It is also compatible with all standard thermostats.

Another advantage is that the system can support a large number of thermostat functions without requiring extra House Wires. It can also be programmed to support other types of data. For example, the system can have the thermostat send the actual temperature to the furnace instead of only a Call for Heat or Call for Cooling.

The source code for implementing the fourth embodiment is reproduced in Appendix C. Because the program for Furnace Adapter 4 (FIGS. 10 and 11) and Thermostat Adapter 4 (FIGS. 12 and 13) are so similar both use the same program with the differences determined by the state of one microcontroller input (Port 1, Bit 5). The code was compiled with Code Composer Studio 6.1.2 for use on a Texas Instruments MSP430G2 LaunchPad Version 1.5. See IDS Cite 16.

Figure 14:
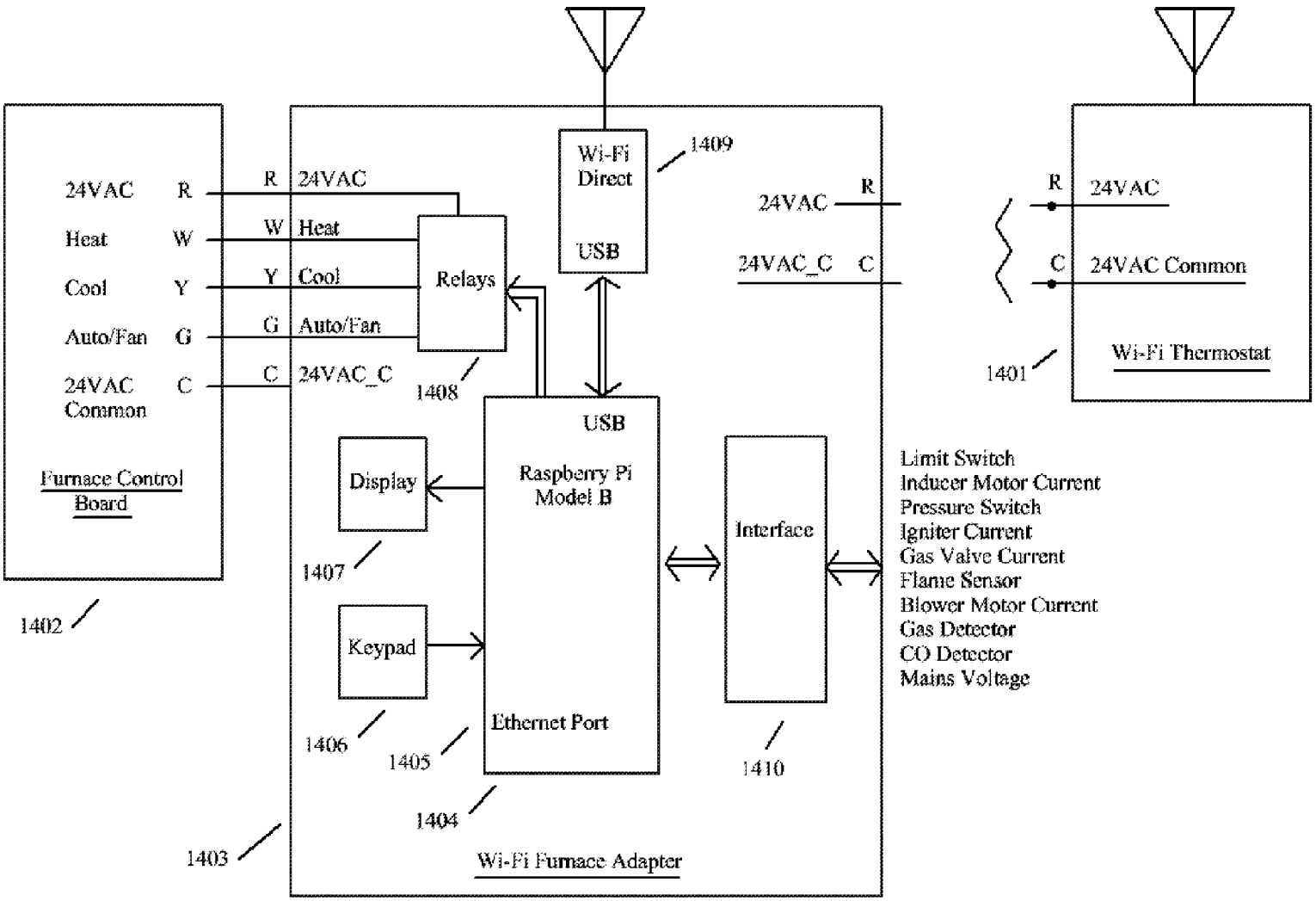
FIG. 14 is a general illustration of the fifth embodiment showing a system with two wires to provide furnace power to the thermostat where a Wi-Fi link is used for communications between the furnace and the thermostat.

The fifth embodiment is shown in FIG. 14. Wi-Fi Thermostat 1401 constitutes a first Wi-Fi node and communicates with Wi-Fi Furnace Adapter 1403 which constitutes a second Wi-Fi node. All of the communications between Wi-Fi Thermostat 1401 and Wi-Fi Furnace Adapter 1403 is done by Wi-Fi so that the House Cable only needs to bring furnace power to Wi-Fi Thermostat 1401, which requires only two wires.

Wi-Fi Furnace Adapter 1403 contains Computer 1404 which may be an inexpensive Raspberry Pi Model B (IDS Cite 171. Computer 1404 uses Wi-Fi Adapter 1409 through a USB port. The reason for using a USB port is so that Wi-Fi Adapter 1409 can be updated to future communications standards without replacing Computer 1404. Wi-Fi Adapter 1409 supports Wi-Fi Direct so that it can communicate directly with Wi-Fi Thermostat 1401 without requiring a separate wireless router in the home. By supporting Wi-Fi Direct the data Wi-Fi Furnace Adapter 1403 can also be accessed directly from a Tablet or a Wi-Fi enabled smart cell phone by running the appropriate App.

Computer 1404 provides the standard control signals to Furnace Control Board 1402 using Relays 1408. The standard control functions include: Call for Heat, Call for Cooling, and Auto/Fan.

Computer 1404 communicates with Display 1407 which is a small display intended for displaying basic information. Keypad 1406 is used for bringing up basic information of Display 1407. Access to comprehensive information is either through Wi-Fi or Ethernet port 1405. Ethernet Port 1405 allows a direct cable connection to Furnace Adapter 1403 in the event there is a problem with the Wi-Fi connection and it is necessary to troubleshoot the system. Ethernet Port 1405 can be used with a device such as a laptop PC or a Tablet with a USB-to-Ethernet adapter. The use of Ethernet Port 1405 with a device other than a router may require the use of a crossover cable.

Interface 1410 connects to a variety of sensors used to monitor the operation of the furnace. Examples are:

1. Limit Switch. The Limit Switch opens when the temperature in the combustion chamber is too high. This may be caused by a blower failure or simply a clogged air filter.
2. Inducer Motor Current. A high current may indicate an impending failure of the Inducer Blower motor. Zero Current may indicate that the Inducer Blower motor has failed or that the cable to the Inducer Blower has failed or become unplugged.
3. Pressure Switch. The Pressure Switch indicates that the Inducer Blower is operating properly by producing sufficient pressure.
4. Igniter Current. An igniter that is failing will draw less current than normal. An igniter that has failed will draw no current. This can also be caused by a failure of the cable to the igniter.
5. Gas Valve Current. A lower than normal or higher than normal current can indicate a problem with the gas valve.
6. Flame Sensor. The operation of the Flame Sensor is critical. The failure to recognize a flame (or the lack of a flame) will shut down the furnace. Some Flame Sensors can indicate flame quality and thus alert the User to an impending failure.

7. Blower Motor Current. A lower than normal or higher than normal current can indicate a problem with the blower. I higher than normal current can also indicate a clogged air filter.

8. Gas Detector. Gas detected around the furnace is a serious problem than requires immediate attention. It may mean that the Gas Valve is open without a flame present or a leak in the gas line.

9. CO Detector. This is another serious problem that requires immediate attention.

10. Mains Voltage. Since the systems runs from the Main Voltage the Mains Voltage should be monitored.

All of the above data should be periodically logged with a timestamp. In addition, all startups and shutdowns of the furnace should be logged with timestamps.

Other useful data that can be collected includes the running time of the system by day, by month, and by year and the cumulative running time since the filter was replaced.

Figure 15:
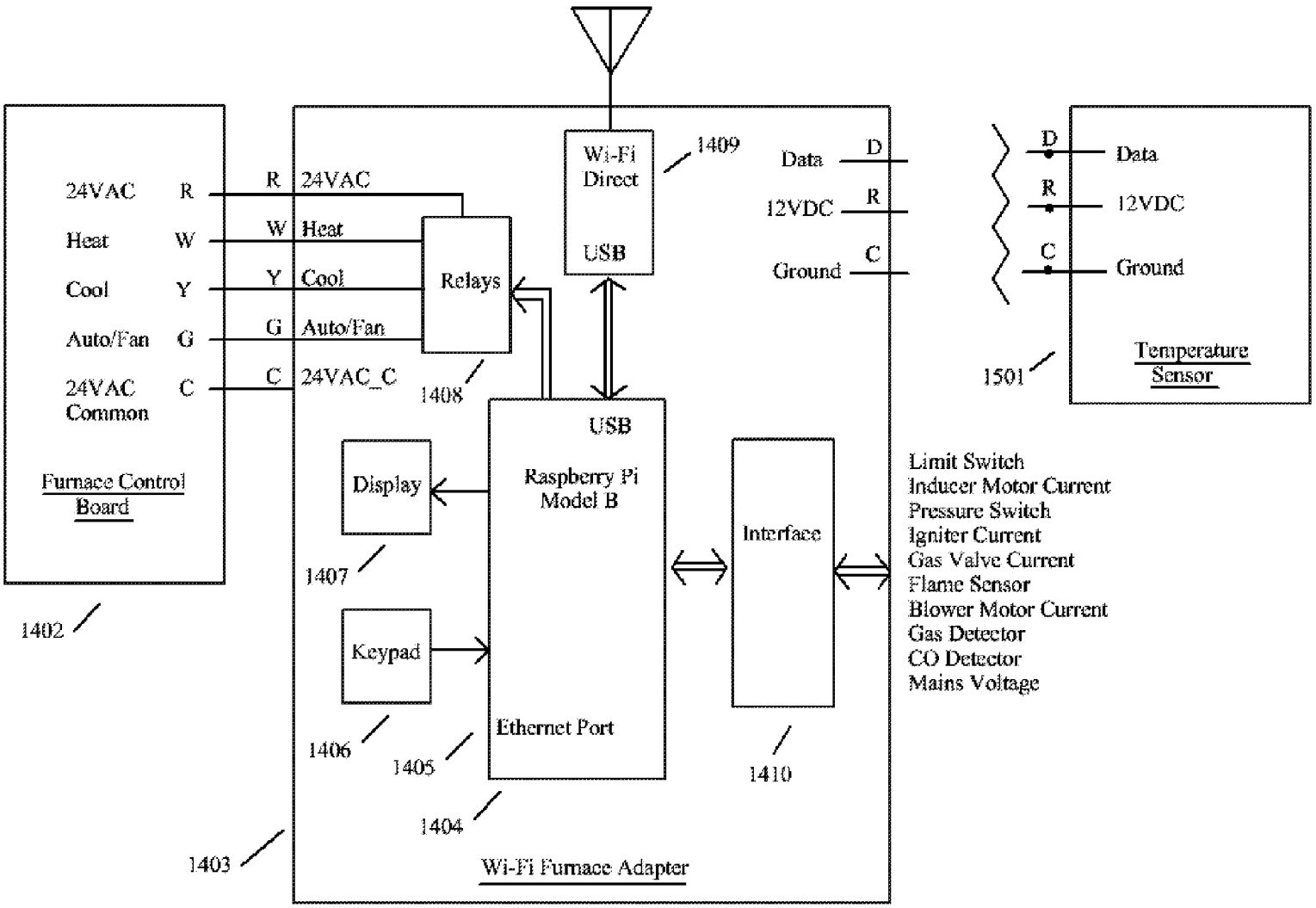
FIG. 15 is a general illustration of the sixth embodiment showing a system with three wires to provide furnace power and a serial communications link which is used for communications between a Wi-Fi enabled furnace and a remote temperature sensor.

Computer 1405 in the fifth embodiment is more than capable of also storing a User's programmed HVAC schedule, so in the sixth embodiment the Wi-Fi Thermostat is replaced with a remote temperature sensor. See FIG. 15. The communications between Wi-Fi Furnace Adapter 1402 and Temperature Sensor 1501 may be a simple serial interface such as the one taught in Embodiment 4. Since this interface does not have to be compatible with existing thermostats 12 VDC is used in the House Cable instead of 24 VAC furnace power. Temperature Sensor 1501 may also contain a humidity sensor so that Wi-Fi Furnace Adapter 1402 can calculate a Comfort Index for controlling the furnace, the air conditioner, and the blower.

While preferred embodiments of the present invention have been shown, it is to be expressly understood that modifications and changes may be made thereto.

APPENDICES

Appendix A: Source code listing for Adapter 3: Furnace Adapter

Appendix B: Source code listing for Adapter 3: Thermostat Adapter

Appendix C: Source code listing for Adapter 4: Both Furnace Adapter and Thermostat Adapter

I claim:

1. A system for providing a backchannel from a furnace location to a thermostat location using polarity splitting comprising:

(a) a furnace, said furnace including a furnace control board;

(b) a low voltage AC power source located at said furnace, said low voltage AC power source having a first phase and a second phase whereby said second phase is opposite in polarity from said first phase;

(c) a furnace adapter, said furnace adapter including a polarity responsive relay and an input for said backchannel;

(d) a thermostat configured to perform one or more HVAC functions;

(e) a thermostat adapter, said thermostat adapter including an indicator, a first diode, and a second diode;

(f) a cable of wires connecting said furnace adapter and said thermostat adapter, said cable of wires comprising a sufficient number of wires to support said one or more HVAC functions and two wires for said low voltage AC power source, said two wires for said low voltage AC power source comprising a first power wire for providing power and a second power wire for providing a common power return for said low voltage AC power source;

whereby (g) said furnace control board is connected to said furnace adapter;

(h) said thermostat is connected to said thermostat adapter;

whereby (i) said first diode on said thermostat adapter conducts a first current produced by a selected HVAC function of said one or more HVAC functions onto a selected wire in said cable of wires connecting said furnace and said thermostat adapter during said first phase of said AC power source;

(j) said polarity responsive relay on said furnace adapter responds to said first current produced by said selected wire during said first phase of said AC power source;

(k) said polarity responsive relay controls a second current to said furnace control board for said selected HVAC function;

(l) the state of said input for said backchannel on said furnace adapter controls a third current on said selected wire to said thermostat adapter during said second phase of said AC power source;

(m) said second diode on said thermostat adapter conducts said third current from said selected wire to said indicator on said thermostat adapter during said second phase of said AC power source.

2. The system of claim 1 whereby said polarity responsive relay is selected from a list consisting of an electromechanical relay and a solid state relay.

3. A system for providing two or more backchannels from a furnace location to a thermostat location using polarity splitting comprising:

(a) a furnace, said furnace including a furnace control board;

(b) a low voltage AC power source located at said furnace, said low voltage AC power source having a first phase and a second phase whereby said second phase is opposite in polarity from said first phase;

(c) a furnace adapter, said furnace adapter including a polarity responsive relay, a furnace adapter microcontroller, a first AC power phase detector for detecting the phase of said low voltage AC power source, and at least a first input for a first backchannel and a second input for a second backchannel;

(d) a thermostat configured to perform one or more HVAC functions;

(e) a thermostat adapter, said thermostat adapter including a thermostat adapter microcontroller, a second AC power phase detector for detecting the phase of said low voltage AC power source, a first diode, and at least a first indicator and a second indicator;

(f) a cable of wires connecting said furnace adapter and said thermostat adapter, said cable of wires comprising a sufficient number of wires to support said one or more HVAC functions and two wires for said low voltage AC power source, said two wires for said low voltage AC power source comprising a first power wire for providing power and a second power wire for providing a common power return for said low voltage AC power source;

whereby (g) said furnace control board is connected to said furnace adapter;

(h) said thermostat is connected to said thermostat adapter;

whereby (i) said first diode on said thermostat adapter conducts a first current produced by a selected HVAC function of said one or more HVAC functions onto a selected wire in said cable of wires connecting said furnace adapter and said thermostat adapter during said first phase of said AC power source;

(j) said polarity responsive relay on said furnace adapter responds to said first current produced by said selected wire during said first phase of said AC power source;

(k) said polarity responsive relay controls a second current to said furnace control board for said selected HVAC function;

(l) said furnace adapter microcontroller reads the states of said first input for said first backchannel and said second input for said second backchannel on said furnace adapter, reads the state of said first AC power phase detector, and during said second phase of said AC power source sends the state of said first input for said first backchannel during a first time slot onto said selected wire and the state of said second input for said second backchannel during a second time slot onto said selected wire to said thermostat adapter;

(m) said thermostat adapter microcontroller reads the state of said second AC power phase detector, and during said second phase of said AC power source reads the state of said selected wire during said first time slot and again during said second time slot whereby the state of said selected wire during said first time slot controls said first indicator and the state of said selected wire during said second time slot controls said second indicator.

4. The system of claim 3 whereby said polarity responsive relay is selected from a list consisting of an electromechanical relay and a solid state relay.

5. A system for providing one or more backchannels from a furnace location to a thermostat location using polarity splitting comprising:

(a) a furnace, said furnace including a furnace control board;

(b) a low voltage AC power source located at said furnace, said low voltage AC power source having a first phase and a second phase whereby said second phase is opposite in polarity from said first phase;

(c) a furnace adapter, said furnace adapter including a furnace adapter microcontroller, one or more relays, and one or more inputs for said one or more backchannels, said furnace adapter microcontroller further including a UART for transmitting and receiving data;

(d) a thermostat configured to perform one or more HVAC functions;

(e) a thermostat adapter, said thermostat adapter including a thermostat adapter microcontroller, one or more inputs responsive to the HVAC functions performed by said thermostat, and one or more indicators, said thermostat adapter microcontroller further including a UART for transmitting and receiving data;

(f) a cable of wires connecting said furnace adapter and said thermostat adapter comprising three or more wires, whereby at least a first wire is connected to a first power wire for said low voltage AC power source, a second wire is connected to a second power wire used for the power common return wire for said low voltage AC power source, and said cable of wires further comprising a third wire for bidirectional communications between said furnace adapter and said thermostat adapter;

whereby (g) the transmitter in said UART in said furnace adapter microcontroller transmits furnace adapter data onto said third wire for bidirectional communications between said furnace adapter and said thermostat adapter during said first phase of said AC power source;

(h) the receiver in said UART for said thermostat adapter microcontroller receives said furnace adapter data transmitted by said UART in said furnace adapter microcontroller onto said third wire for bidirectional communications between said furnace adapter and said thermostat adapter during said first phase of said AC power source;

(i) the transmitter in said UART in said thermostat adapter microcontroller transmits thermostat adapter data onto said third wire for bidirectional communications between said furnace adapter and said thermostat adapter during said second phase of said AC power source;

(j) the receiver in said UART for said furnace adapter microcontroller receives said thermostat adapter data transmitted by said UART in said thermostat adapter microcontroller onto said third wire for bidirectional communications between said furnace adapter and said thermostat adapter during said second phase of said AC power source;

whereby (k) said thermostat adapter data received by said furnace adapter controls said relays on said furnace adapter;

(l) said furnace adapter data received by said thermostat adapter controls said one or more indicators on said thermostat adapter.

6. The system of claim 5 whereby said one or more relays on said furnace adapter are selected from a list consisting of an electromechanical relay and a solid state relay.

7. The system of claim 1 further including:

(a) a second polarity responsive relay and a third polarity responsive relay;

(b) said thermostat additionally configured to perform at least a second HVAC function and a third HVAC function;

(c) said thermostat adapter additionally including a third diode and a fourth diode;

(d) said cable of wires connecting said furnace adapter and said thermostat adapter additionally including an additionally selected wire;

whereby (e) said third diode on said thermostat adapter conducts a fourth current produced by said second HVAC function on said additionally selected wire during said first phase of said AC power source;

(f) said second polarity responsive relay on said furnace adapter responds to said fourth current produced by said additionally selected wire during said first phase of said AC power source;

(g) said second polarity responsive relay controls a fifth current to said furnace control board for said second HVAC function;

(h) said fourth diode on said thermostat adapter conducts a sixth current produced by said third HVAC function on said additionally selected wire during said second phase of said AC power source;

(i) said third polarity responsive relay on said furnace adapter responds to said sixth current produced by said additionally selected wire during said second phase of said AC power source;

(j) said third polarity responsive relay controls a seventh current to said furnace control board for said third HVAC function.

8. The system of claim 7 whereby said second polarity responsive relay is selected from a list consisting of an electromechanical relay and a solid state relay and said third polarity responsive relay is selected from a list consisting of an electromechanical relay and a solid state relay.

9. A method for providing one or more backchannels from a furnace to a thermostat comprising the steps of:

(a) providing a furnace, said furnace including a furnace control board;

(b) providing a thermostat configured to perform one or more HVAC functions;

(c) providing a low voltage AC power source located at said furnace, said low voltage AC power source having a first phase and a second phase whereby said second phase is opposite in polarity from said first phase;

(d) providing a cable of wires connecting said furnace controller and said thermostat, said cable of wires comprising a sufficient number of wires to support said one or more HVAC functions and two wires for said low voltage AC power source, said two wires for said low voltage AC power source comprising a first power wire for providing power and a second power wire for providing a common power return for said low voltage AC power source;

(e) using polarity splitting on a selected wire in said cable of wires connecting said furnace controller and said thermostat whereby said one or more HVAC functions are communicated from said thermostat to said furnace controller during said first phase of said low voltage AC power source and said one or more backchannels are communicated from said furnace controller to said thermostat during said second phase of said low voltage AC power source.

* * * * *